US009711131B2

(12) United States Patent
Christoph

(10) Patent No.: US 9,711,131 B2
(45) Date of Patent: Jul. 18, 2017

(54) SOUND ZONE ARRANGEMENT WITH ZONEWISE SPEECH SUPPRESSION

(71) Applicant: Harman Becker Automotive Systems GmbH, Karlsbad (DE)

(72) Inventor: Markus Christoph, Straubing (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 0 days.

(21) Appl. No.: 14/984,769

(22) Filed: Dec. 30, 2015

(65) Prior Publication Data

US 2016/0196818 A1 Jul. 7, 2016

(30) Foreign Application Priority Data

Jan. 2, 2015 (EP) ..... 15150040

(51) Int. Cl.
*G10K 11/178* (2006.01)
*H04R 3/12* (2006.01)
(Continued)

(52) U.S. Cl.
CPC ..... *G10K 11/1786* (2013.01); *G10K 11/175* (2013.01); *H04R 3/12* (2013.01);
(Continued)

(58) Field of Classification Search
CPC ..... G10K 11/1786; G10K 2210/1282; G10K 2210/3046; G10K 2210/3216;
(Continued)

(56) References Cited

U.S. PATENT DOCUMENTS 7,433,821 B2 10/2008 Obranovich et al.
8,126,159 B2 * 2/2012 Goose ..... H04S 3/002 381/302
(Continued)

FOREIGN PATENT DOCUMENTS

CA 2471674 A1 12/2005
EP 1770685 A1 4/2007
EP 2211564 A1 7/2010

OTHER PUBLICATIONS

Extended European Search Report for corresponding Application No. 15150040.2, mailed Jul. 22, 2015, 6 pages.
(Continued)

*Primary Examiner* — Brenda Bernardi
(74) *Attorney, Agent, or Firm* — Brooks Kushman P.C.

(57) ABSTRACT

A system and method for arranging sound zones in a room including a listener's position and a speaker's position with a multiplicity of loudspeakers disposed in the room and a multiplicity of microphones disposed in the room. The method includes establishing, in connection with the multiplicity of loudspeakers, a first sound zone around the listener's position and a second sound zone around the speaker's position, and determining, in connection with the multiplicity of microphones, parameters of sound conditions present in the first sound zone. The method further includes generating in the first sound zone, in connection with the multiplicity of loudspeakers, and based on the determined sound conditions in the first sound zone, speech masking sound that is configured to reduce common speech intelligibility in the second sound zone.

20 Claims, 22 Drawing Sheets

(51) Int. Cl.
*H04S 7/00* (2006.01)
*G10K 11/175* (2006.01)

(52) U.S. Cl.
CPC ..... *H04S 7/301* (2013.01); *H04S 7/303* (2013.01); *G10K 2210/1282* (2013.01); *G10K 2210/3046* (2013.01); *G10K 2210/3213* (2013.01); *G10K 2210/3216* (2013.01)

(58) Field of Classification Search
CPC . G10K 2210/3213; H04S 7/301; H04S 7/303; H04R 3/12
See application file for complete search history.

(56) References Cited

U.S. PATENT DOCUMENTS 8,731,907 B2 5/2014 Cheng
2006/0009969 A1* 1/2006 L'Esperance ..... G10K 11/175 704/226
2009/0074199 A1* 3/2009 Kierstein ..... G10K 11/175 381/71.6
2010/0124337 A1* 5/2010 Wertz ..... G10K 11/1782 381/71.11
2010/0189275 A1* 7/2010 Christoph ..... H04R 3/005 381/66
2011/0002477 A1 1/2011 Zickmantel
2013/0185061 A1 7/2013 Arvanaghi et al.
2014/0348354 A1* 11/2014 Christoph ..... H04R 29/001 381/303

OTHER PUBLICATIONS

Modegi, "Auditory Masking Control System for Protecting Speech Privacy by Playing Back Filtered BGM Sounds With Flat-Panel Loudspeakers", SICE Annual Conference, Sep. 14-17, 2013, Nagoya University, Nagoya, Japan, pp. 1663-1670.
Wikipedia, "Speech Transmission Index", Oct. 8, 2014, 6 pages.

* cited by examiner

SOUND ZONE ARRANGEMENT WITH ZONEWISE SPEECH SUPPRESSION

CROSS-REFERENCE TO RELATED APPLICATIONS

This application claims priority to EP Application Serial No. 15150040 filed Jan. 2, 2015, the disclosure of which is hereby incorporated in its entirety by reference herein.

TECHNICAL FIELD

The disclosure relates to a sound zone arrangement with speech suppression between at least two sound zones.

BACKGROUND

Active noise control may be used to generate sound waves or "anti-noise" that destructively interferes with non-useful sound waves. The destructively interfering sound waves may be produced through a loudspeaker to combine with the non-useful sound waves in an attempt to cancel the non-useful noise. Combination of the destructively interfering sound waves and the non-useful sound waves can eliminate or minimize perception of the non-useful sound waves by one or more listeners within a listening space.

An active noise control system generally includes one or more microphones to detect sound within an area that is targeted for destructive interference. The detected sound is used as a feedback error signal. The error signal is used to adjust an adaptive filter included in the active noise control system. The filter generates an anti-noise signal used to create destructively interfering sound waves. The filter is adjusted to adjust the destructively interfering sound waves in an effort to optimize cancellation according to a target within a certain area called sound zone or, in case of full cancellation, quiet zone. In particular closely disposed sound zones as in vehicle interiors may result in more difficulty optimizing cancellation, i.e., in establishing acoustically fully separated sound zones, particularly in terms of speech. In many cases, a listener in one sound zone may be able to listen to a person talking in another sound zone although the talking person does not intend or desire that another person participates. For example, a person on the rear seat of a vehicle (or on the driver's seat) wants to make a confidential telephone call without involving another person on the driver's seat (or on the rear seat). Therefore, a need exists to optimize speech suppression between at least two sound zones in a room.

SUMMARY

A sound zone arrangement includes a room including a listener's position and a speaker's position, a multiplicity of loudspeakers disposed in the room, a multiplicity of microphones disposed in the room, and a signal processing module. The signal processing module is connected to the multiplicity of loudspeakers and to the multiplicity of microphones. The signal processing module is configured to establish, in connection with the multiplicity of loudspeakers, a first sound zone around the listener's position and a second sound zone around the speaker's position, and to determine, in connection with the multiplicity of microphones, parameters of sound conditions present in the first sound zone. The signal processing module is further configured to generate in the first sound zone, in connection with the multiplicity of loudspeakers, and based on the determined sound conditions in the first sound zone, speech masking sound that is configured to reduce common speech intelligibility in the second sound zone.

A method for arranging sound zones in a room including a listener's position and a speaker's position with a multiplicity of loudspeakers disposed in the room and a multiplicity of microphones disposed in the room includes establishing, in connection with the multiplicity of loudspeakers, a first sound zone around the listener's position and a second sound zone around the speaker's position, and determining, in connection with the multiplicity of microphones, parameters of sound conditions present in the first sound zone. The method further includes generating in the first sound zone, in connection with the multiplicity of loudspeakers, and based on the determined sound conditions in the first sound zone, speech masking sound that is configured to reduce common speech intelligibility in the second sound zone.

Other systems, methods, features and advantages will be or will become apparent to one with skill in the art upon examination of the following detailed description and figures. It is intended that all such additional systems, methods, features and advantages be included within this description, be within the scope of the invention and be protected by the following claims.

BRIEF DESCRIPTION OF THE DRAWINGS

The system may be better understood with reference to the following description and drawings. The components in the figures are not necessarily to scale, emphasis instead being placed upon illustrating the principles of the invention. Moreover, in the figures, like referenced numerals designate corresponding parts throughout the different views.

DETAILED DESCRIPTION

Figure 1:
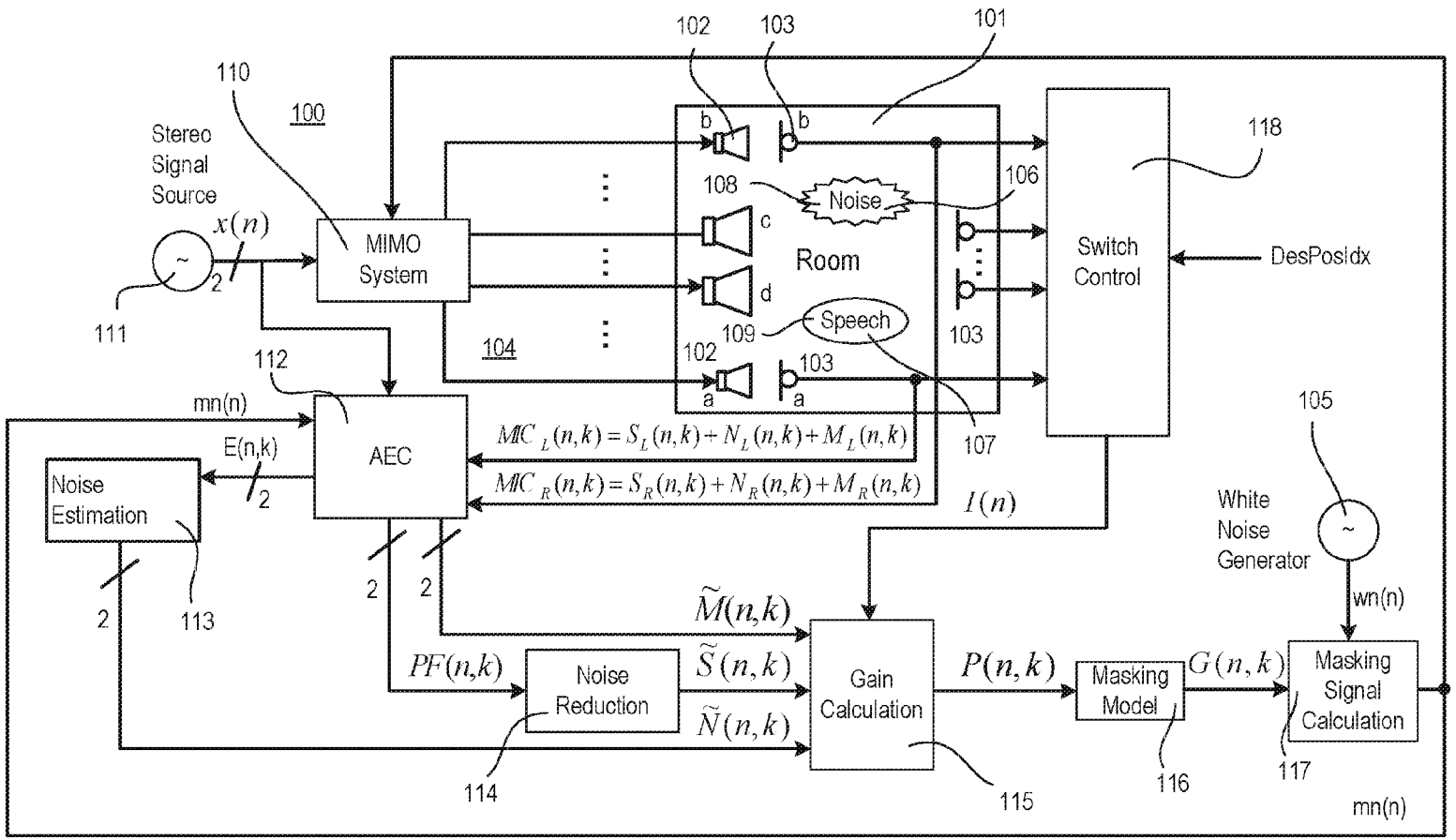
FIG. 1 is a block diagram illustrating an exemplary sound zone arrangement with speech suppression in at least one sound zone.

For example, multiple-input multiple-output (MIMO) systems, allow for generating in any given space virtual sources or reciprocally isolated acoustic zones, in this context also referred to as "individual sound zones" (ISZ) or just sound zones. Creating individual sound zones has caught greater attention not only by the possibility of providing different acoustic sources in diverse areas, but especially by the prospect of conducting speakerphone conversations in an acoustically isolated zone. For the distant (or remote) speaker of a telephone conversation this is already possible using present-day MIMO systems without any additional modifications, as these signals already exist in electrical or digital form. The signals produced by the speaker at the other end, however, present a greater challenge, as these signals must be received by a microphone and stripped of music, ambient noise (also referred to as background noise) and other disruptive elements before they can be fed into the MIMO system and passed on to the corresponding loudspeakers.

At this point the MIMO systems, in combination with the loudspeakers, produce a wave field which generates, at specific locations, acoustically illuminated (enhanced) zones, so-called bright zones, and in other areas, acoustically darkened (suppressed) zones, so-called dark zones. The greater the acoustic contrast between the bright and dark zones, the more effective the cross talk cancellation (CTC) between the particular zones will be and the better the ISZ system will perform. Besides the aforementioned difficulties involving extracting the near-speaker's voice signal from the microphone signal(s), an additional problem is the time available for processing the signal, in other words: the latency.

Based on the assumption of ideal conditions, existing, for example, when the near-speaker uses a mobile telephone and talks directly into the microphone and when loudspeakers are positioned in the headrest for use at places where the near-speaker's voice signal should not be audible or, at the very least, understandable, the interval in a luxury-class vehicle is approximately $x \leq 1.5$ m which, at the sound velocity of $c=343$ m/s at a temperature of $T=20°$ C. results in a maximum processing time of approximately $\leq 4.4$ ms. Within this time span everything must be completed; that means the signal must be received, processed and reproduced.

Even the latency that arises over a Bluetooth Smart Technology connection is at $t=6$ ms already considerably longer than the available processing time. When headrest loudspeakers are employed, an average distance from the speakers to the ears of approximately $x=0.2$ m can be assumed, and even here a signal processing time of only $t<4$ ms is available, which may be regarded as a sufficient, but at any rate critical amount of time. And even if enough processing time were at hand to isolate the voice signal from the microphone of the near-speaker and to feed it into a MIMO system, this would not make it possible to accomplish the given task.

Basically, the overall performance, i.e., the degree and also the bandwidth of the CTC of a MIMO system, depends on the distance from the loudspeakers to the areas into which the desired wave field should be projected (e.g., ear positions). Even when loudspeakers are positioned in the headrests, which in reality probably represents one of the best options, i.e., representing the shortest distance possible from the loudspeakers to the ears, it is only possible to achieve a CTC bandwidth of maximum $f \leq 2$ kHz. This means that, even under the best of conditions and assuming sufficient cancellation of the near-speaker's voice signal in the driver's seat, with the aid of a MIMO or ISZ system a bandwidth of only $\leq 2$ k Hz can be expected.

However, a voice signal that lies above this frequency still typically possesses so much energy, or informational content, that even speech that is restricted to frequencies above this bandwidth can easily be understood. In addition to this, the natural acoustic masking generally brought about by the ambient noise in a motor vehicle, e.g. road and motor noise, is hardly effective at frequencies above 2 kHz. If looked at realistically, the attempt to achieve a sufficient CTC between the loudspeaker and the ambient space in which a voice should be rendered, at the very least, incomprehensible by using an ISZ system would not be successful.

The approach described herein provides projecting a masking signal of sufficient intensity and spectral bandwidth into the area in which the telephone conversation should not be understood for the duration of the call, so that at least the voice signal of the near-speaker (sitting, for example, on the driver's seat) cannot be understood. Both the near-speaker's voice signal and the voice signal of the distant speaker may be used to control the masking signal. However, another sound zone may be established around a communications terminal (such as a cellular telephone) used by the speaker in the vehicle interior. This additional sound zone may be established in the same or a similar manner as the other sound zones. Regardless which signal (or signals) is used to control the (electrical) masking signal, the employed signal should in no case cause disturbance at the position of the near-speaker he or she should be left completely or at least to the greatest extent possible undisturbed by or unaware of the (acoustic) masking sound based on the masking signal. However, the masking signal (or signals) should be able to reduce speech intelligibility to a level where, for example, a telephone conversation in one sound zone cannot be understood in another sound zone.

Speech Transmission Index (STI) is a measure of speech transmission quality. The STI measures some physical characteristics of a transmission channel, and expresses the ability of the channel to carry across the characteristics of a speech signal. STI is a well-established objective measurement predictor of how the characteristics of the transmission channel affect speech intelligibility. The influence that a transmission channel has on speech intelligibility may be dependent on, for example, the speech level, frequency response of the channel, non-linear distortions, background noise level, quality of the sound reproduction equipment, echoes (e.g., reflections with delays of more than 100 ms), the reverberation time, and psychoacoustic effects (such as masking effects).

More precisely, the speech transmission index (STI) is an objective measure based on the weighted contribution of a number of frequency octave bands within the frequency range of speech. Each frequency octave band signal is modulated by a set of different modulation frequencies to define a complete matrix of differently modulated test signals in different frequency octave bands. A so-called modulation transfer function, which defines the reduction in modulation, is determined separately for each modulation frequency in each octave band, and subsequently the modulation transfer function values for all modulation frequencies and all octave bands are combined to form an overall measure of speech intelligibility. It also has been recognized that there is a benefit in moving from subjective evaluation of the intelligibility of speech in a region toward a more quantitative approach which, at the very least, provides a greater degree of repeatability.

A standardized quantitative measure of speech intelligibility is the Common Intelligibility Scale (CIS). Various machine-based methods such as Speech Transmission Index (STI), Speech Transmission Index Public Address (STI-PA), Speech Intelligibility Index (SII), Rapid Speech Transmission Index (RASTI), and Articulation Loss of Consonants (ALCONS) can be mapped to the CIS. These test methods have been developed for use in evaluating speech intelligibility automatically and without any need for human interpretation of the speech intelligibility. For example, the Common Intelligibility Scale (CIS) is based on a mathematical relation with STI according to CIS=1+log (STI). It is understood that the common speech intelligibility is sufficiently reduced if the level is below 0.4 on the common intelligibility scale (CIS).

Referring to FIG. 1, an exemplary sound zone arrangement 100 includes a multiplicity of loudspeakers 102 disposed in a room 101 and a multiplicity of microphones 103 also disposed in the room 101. A signal processing module 104 is connected to the multiplicity of loudspeakers 102, the multiplicity of microphones 103, and a white noise source 105 which generates white noise, i.e., a signal with a random phase characteristic. The signal processing module 104 establishes, by way of the multiplicity of loudspeakers 102, a first sound zone 106 around a listener's position (not shown) and a second sound zone 107 around a speaker's position (not shown), and determines, in connection with the multiplicity of microphones 103, parameters of sound conditions present in the first sound zone 106 and maybe additionally in the second sound zone 107. Sound conditions may include, inter alia, the characteristics of at least one of the speech sound in question, ambient noise and additionally generated masking sound. The signal processing module 104 then generates in the first sound zone 106, in connection with a masking noise mn(n) and the multiplicity of loudspeakers 102, and based on the determined sound conditions in the first sound zone 106 (and maybe second sound zone 107), masking sound 108 (e.g., noise) that is appropriate for reducing common speech intelligibility of speech 109 transmitted from the second sound zone 107 to the first sound zone 106 to a level below 0.4 on the common intelligibility scale (CIS). The level may be reduced to CIS levels below 0.3, 0.2 or even below 0.1 to further raise the degree of privacy of the speaker, however, this may increase the noise level around the listener to unpleasant levels dependent on the particular sound situation in the second sound zone 107.

The signal processing module 104 includes, for example, a MIMO system 110 that is connected to the multiplicity of loudspeakers 102, the multiplicity of microphones 103, the masking noise mn(n), and a useful signal source such as a stereo music signal x(n) providing stereo signal source 111. MIMO systems may include a multiplicity of outputs (e.g., output channels for supplying output signals to a multiplicity of groups of loudspeakers) and a multiplicity of (error) inputs (e.g., recording channels for receiving input signals from a multiplicity of groups of microphones, and other sources). A group includes one or more loudspeakers or microphones that are connected to a single channel, i.e., one output channel or one recording channel. It is assumed that the corresponding room or loudspeaker-room-microphone system (a room in which at least one loudspeaker and at least one microphone is arranged) is linear and time-invariant and can be described by, e.g., its room acoustic impulse responses. Furthermore, a multiplicity of original input signals such as the useful (stereo) input signals x(n) may be fed into (original signal) inputs of the MIMO system. The MIMO system may use, for example, a multiple error least mean square (MELMS) algorithm for equalization, but may employ any other adaptive control algorithm such as a (modified) least mean square (LMS), recursive least square (RLS), etc. Useful signal(s) x(n) may be filtered by a multiplicity of primary paths, which are represented by a primary path filter matrix on its way from one of the multiplicity of loudspeakers 102 to the multiplicity of microphones 103 at different positions, and provides a multiplicity of useful signals d(n) at the end of the primary paths, i.e., at the multiplicity of microphones 103. In the exemplary arrangement shown in FIG. 1, there are 4 (groups of) loudspeakers, 4 (groups of) microphones, and 3 original inputs, i.e., a stereo signal x(n) and the masking signal mn(n). It should be noted that, if the MIMO system is of adaptive nature, the signals output by the multiplicity of microphones 103 are input into the MIMO system.

The signal processing module 104 further includes, for example, an acoustic echo cancellation (AEC) system 112. In general, acoustic echo cancellation can be attained, e.g., by subtracting an estimated echo signal from the useful sound signal. To provide an estimate of the actual echo signal, algorithms have been developed that operate in the time domain and that may employ adaptive digital filters processing time-discrete signals. Such adaptive digital filters operate in such a way that the network parameters defining the transmission characteristics of the filter are optimized with reference to a preset quality function. Such a quality function is realized, for example, by minimizing the average square errors of the output signal of the adaptive network with reference to a reference signal. Other AEC modules are known that are operated in the frequency domain. In the exemplary arrangement shown in FIG. 1, AEC modules as described above, either in the time domain or the frequency domain, are used, however, echoes are herein understood to be the useful signal (e.g., music) fraction received by a microphone which is disposed in the same room as the music playback loudspeaker(s).

AEC module 112 receives output signals $Mic_L(n,k)$ and $Mic_R(n,k)$ of two microphones 103*a* and 103*b* of the multiplicity of microphones 103, wherein these particular microphones 103*a* and 103*b* are arranged in the vicinity of two particular loudspeakers 102*a* and 102*b* of the multiplicity of loudspeakers 102. The loudspeakers 102*a* and 102*b* may be disposed in the headrests of a (vehicle) seat in the room (e.g., the interior of a vehicle). The output signal $Mic_L(n,k)$ may be the sum of a useful sound signal $S_L(n,k)$, a noise signal $N_L(n,k)$ representing the ambient noise present in the room 101 and a masking signal $M_L(n,k)$ representing the masking signal based on the masking noise signal mn(n). Accordingly, the output signal $Mic_R(n,k)$ may be the sum of a useful sound signal $S_R(n,k)$, a noise signal $N_R(n,k)$ representing the ambient noise present in the room 101 and a masking signal $M_R(n,k)$ representing the masking signal based on the masking noise signal mn(n). AEC module 112 further receives the stereo signal x(n) and the masking signal mn(n), and provides an error signal E(n,k), an output (stereo) signal PF(n,k) of an adaptive post filter within the AEC module 112 and a (stereo) signal $\tilde{M}(n,k)$ representing the estimate of the echo signal(s) of the useful signal(s). It is understood that ambient/background noise includes all types of sound that does not refer to speech sound to be masked so that ambient/background noise may include noise generated by the vehicle, music present in the interior and even speech sound of other persons who do not participate in the communication in the speaker's sound zone. It is further understood that no further masking sound is needed if the ambient/background noise provides sufficient masking.

The signal processing module 104 further includes, for example, a noise estimation module 113, noise reduction module 114, gain calculation module 115, masking modeling module 116, and masking signal calculation module 117. The noise estimation module 113 receives the (stereo) error signal E(n,k) from AEC module 112 and provides a (stereo) signal $\tilde{N}(n,k)$ representing an estimate of the ambient (background) noise. The noise reduction module 114 receives the output (stereo) signal PF(n,k) from AEC module 112 and provides a signal $\tilde{S}(n,k)$ representing an estimate of the speech signal as perceived at the listener's ear positions. Signals $\tilde{M}(n,k)$, $\tilde{S}(n,k)$ and $\tilde{N}(n,k)$ are supplied to the gain calculation module 115, which is also supplied with a signal I(n) and which supplies the power spectral density P(n,k) of the near speaker's speech signals as perceived at the listener's ear positions based on the signals $\tilde{M}(n,k)$, $\tilde{S}(n,k)$ and $\tilde{N}(n,k)$, to the masking modeling module 116. Alternatively to the masking model or additionally a common intelligibility model may be used. The masking modeling module 116 provides a signal G(n,k) which represents the masking threshold of the power spectral density P(n,k) of the estimated near speaker's speech signals as perceived at the listener's ear positions, exhibiting the magnitude frequency response of the desired masking signal. By combining signal G(n,k) with a white noise signal wn(n), which is provided by white noise source 105 and which delivers the phase frequency response of the desired masking signal, in masking signal calculation module 117 the masking signal mn(n) will be generated, which is then, inter alia, provided to the MIMO system 110. The signal processing module 104 further includes, for example, a switch control module 118, which receives the output signals of the multiplicity of microphones 103 and a signal DesPosIdx, and which provides the signal I(n).

In a room, which, in the present example, is the cabin of a motor vehicle, a multitude of loudspeakers are positioned, together with microphones. In addition to the existing system loudspeakers, (acoustically) active headrests may also be employed. The term "Active Headrest" refers to a headrest into which one or more loudspeakers and one or more microphones are integrated such as the combinations of loudspeakers and microphones described above (e.g., combinations 217-220). The loudspeakers positioned in the room are used, i.a., to project useful signals, for example music, into the room. This leads to the formation of echoes. Again, "echo" refers to a useful signal (e.g. music) that is received by a microphone located in the same room as the playback loudspeaker(s). The microphones positioned in the room record useful signals as well as other signals, such as ambient noise or speech. The ambient noise may be generated by a multitude of sources, such as road traction, ventilators, wind, the engine of the vehicle or it may consist of other disturbing sound entering the room. The speech signals, on the other hand, may come from any passengers present in the vehicle and, depending on their intended use, may be regarded either as useful signals or as sources of disruptive background noise.

The signals from the two microphones integrated into the headsets and positioned in regions in which a telephone call should be rendered unintelligible must first of all be cleansed of echoes. For this purpose, in addition to the aforementioned microphone signals, corresponding reference signals (in this case useful stereo signals such as music signals and a masking signal, which is generated) are fed into the AEC module. As output signals the AEC module provides, for each of the two microphones, a corresponding error signal $E_{L/R}(n, k)$ from the adaptive filter, an output signal of the adaptive post filter $PF_{L/R}(n, k)$, and the echo signal of the useful signal (e.g. music) as received by the corresponding microphone $\tilde{M}_{L/R}(n, k)$.

In the noise estimation module 113 the (ambient) noise signal $\tilde{N}_{L/R}(n, k)$ present at each microphone position is estimated based on the error signals $E_{L/R}(n, k)$. In the noise reduction module 114 a further reduction of ambient noise is carried out based on the output signals of the adaptive post filters $PF_{L/R}(n, k)$, which also suppress what is left of the echo and part of the ambient noise. The output, then, from the noise reduction module 114 is an estimate of the speech signal k) coming from the microphones that has been largely cleansed of ambient noise. Using the thus obtained isolated estimates of the useful signal's echo signal $\tilde{M}_{L/R}(n, k)$, the background noise signal $\tilde{N}_{L/R}(n, k)$ and of the speech signal $\tilde{S}(n, k)$ as found in the area in which the conversation is to be rendered unintelligible, together with the signal I(n) (which will be discussed in greater detail further below), the power spectral density P(n,k) is calculated in the module Gain Calculation. On the basis of these calculations, the magnitude frequency response value of the masking signal G(n,k) is then calculated. The power spectral density P(n,k) should be configured to ensure that a masking signal is only generated when the near or distant speaker is active and only in the spectral regions in which conversation is taking place. Essentially, the power spectral density P(n,k) could also be directly used to generate the frequency response value of the masking signal G(n, k), however, because of the high, narrowband dynamics of this signal, this could result in a signal being generated that does not possess sufficient masking qualities. For this reason, instead of using the power spectral density P(n,k) directly, its masking threshold G(n,k) is used to produce the magnitude frequency response value of the desired masking signal.

In the masking model module 116, the input signal, which is the power spectral density P(n,k), is used to calculate the masking threshold of the masking signal G(n,k) on the basis of the masking model implemented there. The high narrowband dynamic peaks of the power spectral density P(n,k) are clipped by the masking model, as a result of which the masking in these narrow spectral regions becomes insufficient. To compensate for this, a spread spectrum is generated for the masking signal in the spectral area surrounding these spectral peaks, which once again intensifies the masking effect locally, so that, despite the fact that this limits the dynamics of the masking signal, its effective spectral width is enhanced. A thus generated, time and spectral variant masking signal exhibits a minimum bias and is therefore met with greater acceptance by users. Furthermore, in this way the masking effect of the signal is enhanced.

In the masking signal calculation module 117 a white-noise phase frequency response of the white noise signal (wn(n) is superimposed over the existing magnitude frequency response of the masking signal G(n,k), producing a complex masking signal which can then be converted from the spectral domain into the time domain. The end result of this is the desired masking signal mn(n) in time domain, which, on the one hand, can be projected through the MIMO system into the corresponding bright-zone and, on the other hand, must be fed into the AEC module as an additional reference signal, in order to cancel out the echo it causes in the microphone signals and to prevent feedback problems.

The switch control module 118 receives all microphone signals present in the room as its input signals and, based on these, furnishes at its output the time variant, binary weighted signal I(n). This signal indicates whether (I(n)=1) or not (I(n)=0) the estimated speech signal $\tilde{S}(n,k)$ originates from the desired position DesPosIdx, which in this case is the position of the near speaker. Only when the thus estimated position of the source of speech corresponds to the known position of the near speaker DesPosIdx, assumed by default or choice, will a masking signal be generated, otherwise, i.e., when the estimated speech signal $\tilde{S}(n,k)$ contained in the microphone originates from another person in the room, the generation of a masking signal will be prevented. Of course, data from seat detection sensors or cameras could also be evaluated, if available, as an alternative or additional source of input. This would simplify the process considerably and make the system more resistant against potential errors when detecting the signal of the near speaker.

Figure 2:
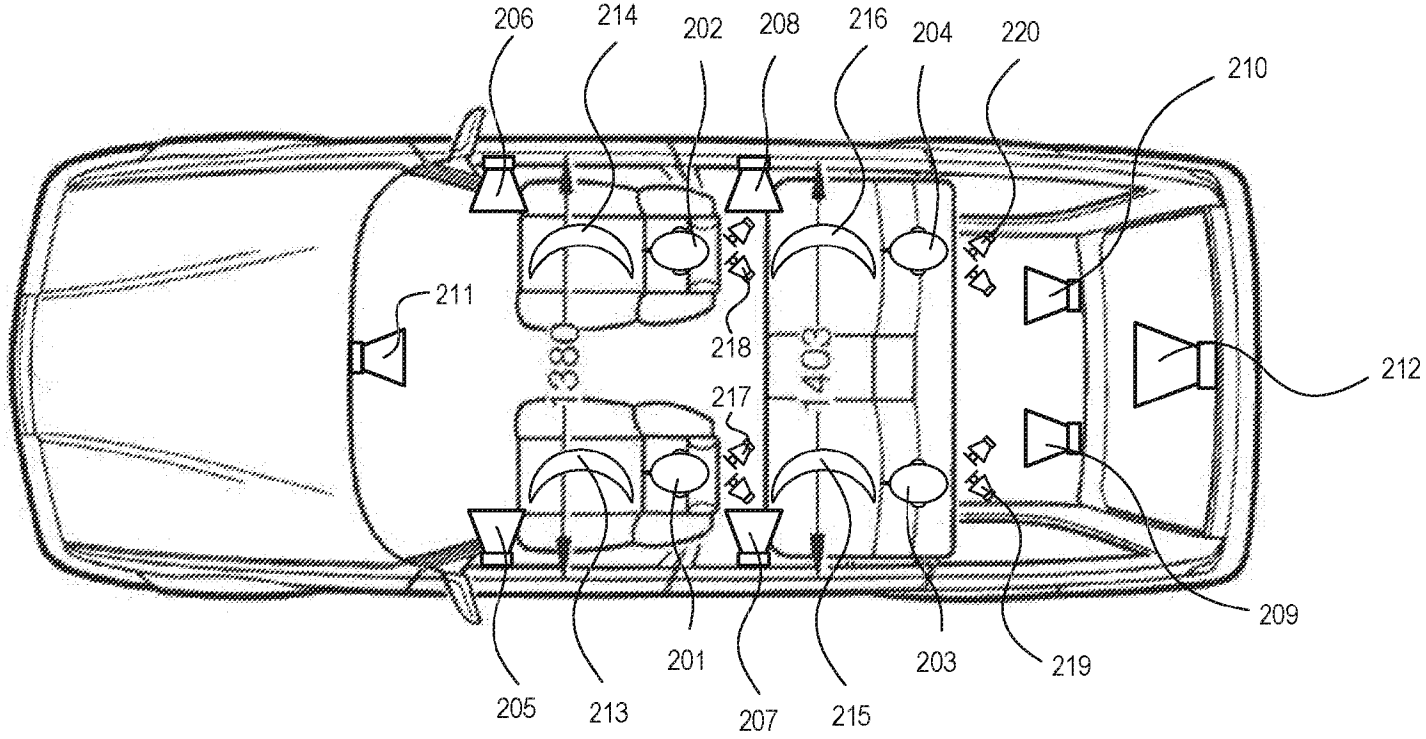
FIG. 2 is a top view of an exemplary vehicle interior in which sound zones are arranged.

Referring to FIG. 2, a room, e.g., a motor vehicle cabin 200, may include four seating positions 201-204, which are a front left position 201 (driver position), front right position 202, rear left position 203 and a rear right position 204. At each position 201-204 a stereo signal with a left and right channel shall be reproduced so that a binaural audio signal shall be received at each position, which may be front left position left and right channels, front right position left and right channels, rear left position left and right channels, rear right position left and right channels. Each channel may include a loudspeaker or a group of loudspeakers of the same type or different type such as woofers, midrange loudspeakers and tweeters. In motor vehicle cabin 200 system loudspeakers 205-210 may be disposed in the left front door (loudspeaker 205), in the right front door (loudspeaker 206), in the left rear door (loudspeaker 207), in the right rear door (loudspeaker 208), on the left rear shelf (loudspeaker 209), on the right rear shelf (loudspeaker 210), in the dashboard (loudspeaker 211) and in the trunk (loudspeaker 212). Furthermore shallow loudspeakers 213-216 are integrated in the roof liner above the seating positions 201-204. Loudspeaker 213 may be arranged above front left position 201, loudspeaker 214 above front right position 202, loudspeaker 215 above rear left position 203, and loudspeaker 216 above rear right position 204. The loudspeakers 213-216 may be slanted in order to increase crosstalk attenuation between the front section and the rear section of the motor vehicle cabin. The distance between the listener's ears and the corresponding loudspeakers may be kept as short as possible to increase crosstalk attenuation between the sound zones. Additionally, loudspeaker-microphone combination 217-220 with pairs of loudspeakers and a microphone in front of each loudspeaker may be integrated into the headrests of the seats at seating positions 201-204, whereby the distance between a listener's ears and the corresponding loudspeakers is further reduced and the headrests of the front seats would provide further crosstalk attenuation between the front seats and the rear seats. For measurement purposes the microphones disposed in front of the headrest loudspeakers may be mounted in the positions of an average listener's ears when sitting in the listening positions. The loudspeakers 213-216 disposed in the roof liner and/or the pairs of loudspeakers of the loudspeaker microphone combinations 217-220 disposed in the headrest may be any directional loudspeakers including electro-dynamic planar loudspeaker (EDPL) to further increase the directivity. As can be seen, of major importance are the positions of the headrest loudspeakers and microphones. The remaining loudspeakers are used for the ISZ system. The system loudspeakers are primarily used to cover the lower spectral range for ISZ, but also for the reproduction of useful signals, such as music. It is to be understood that a MIMO system is a system that provides in an active way a separation between different sound zones, e.g., by way of (adaptive) filters, in contrast to systems that provide the separation in a passive way, e.g., by way of directional loudspeakers or sound lenses. An ISZ system combines active and passive separation.

Figure 3:
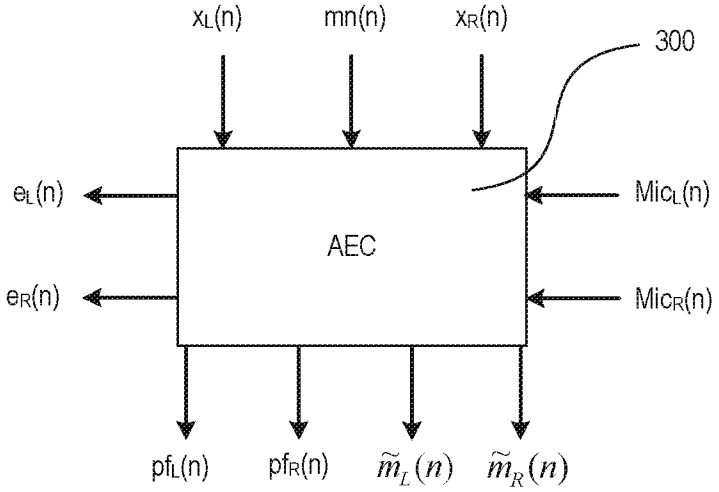
FIG. 3 is a schematic diagram illustrating the inputs and outputs of an acoustic echo cancellation (AEC) module applicable in the arrangement shown in FIG. 1.

As shown in FIG. 3, an exemplary AEC module 300, which may be used as AEC module 112 in the arrangement shown in FIG. 1, may receive microphone signals $Mic_L(n)$ and $Mic_R(n)$, the masking signal mn(n), and the stereo signal x(n) consisting of two individual mono signals $x_L(n)$ and $x_R(n)$, and may provide error signals $e_L(n)$ and $e_R(n)$, post filter output signals $pf_L(n)$ and $pf_R(n)$, and signals $\tilde{m}_L(n)$ and $\tilde{m}_R(n)$ representing estimates of the useful signals as perceived at the listener's ear positions. The AEC module 300 shown in FIG. 3 in application to the arrangement shown in FIG. 2 will be described in more detail below in connection with FIG. 4. The AEC module 300 includes six controllable filters 401-406 (i.e., filters whose transfer functions can be controlled by a control signal) which are controlled by the control module 407. Control module 407 may employ, for example, a normalized least mean square (NLMS) algorithm to generate control signals $\overline{W}_{L/R}(n)$ and $\hat{h}_{L/R}(n)$ from a step size signal $\hat{\mu}_{L/R}(n)$ in order to control transfer functions $\overline{\tilde{W}}_{LL}(n)$, $\overline{\tilde{W}}_{RL}(n)$, $\tilde{h}_L(n)$, $\tilde{h}_R(n)$, $\overline{\tilde{W}}_{LR}(n)$, $\overline{\tilde{W}}_{RR}(n)$ of controllable filters 401-406. The step size signal $\mu_{L/R}(n)$ is calculated by a step size controller module 408 from the two individual mono signals $x_L(n)$ and $x_R(n)$, the masking signal mn(n), and control signals $\overline{W}_{L/R}(n)$ and $\hat{h}_{L/R}(n)$. The step size controller module 408 further calculates and outputs post filter control signals $p_L(n)$ and $p_r(n)$ which control a post filter module 409. Post filter module 409 is controlled to generate from error signals $e_L(n)$ and $e_R(n)$ the post filter output signals $pf_L(n)$ and $pf_R(n)$. The error signals $e_L(n)$ and $e_R(n)$ are derived from microphone signals $Mic_L(n)$ and $Mic_R(n)$ from which correction signals are subtracted. These correction signals are derived from the sum of the signals $\tilde{m}_L(n)$ and $\tilde{m}_R(n)$, and the output signals of controllable filters 403 and 404 (transfer functions $\tilde{h}_L(n)$, $\tilde{h}_R(n)$), wherein signal $\tilde{m}_L(n)$ is the sum of the output signals of controllable filters 401 and 402 (transfer functions $\overline{\tilde{W}}_{LL}(n)$, $\overline{\tilde{W}}_{RL}(n)$) and signal $\tilde{m}_R(n)$ is the sum of the output signals of controllable filters 405 and 406 (transfer functions $\overline{\tilde{W}}_{LR}(n)$, $\overline{\tilde{W}}_{RR}(n)$). Controllable filters 401 and 405 are supplied with signal mono signal $x_L(n)$. Controllable filters 402 and 406 are supplied with mono signal $x_R(n)$. Controllable filters 403 and 404 are supplied with masking signal mn(n). The microphone signals $Mic_L(n)$ and $Mic_R(n)$ may be provided by microphones 103*a* and 103*b* of the multiplicity of microphones 103 in the arrangement shown in FIG. 1 (which may be the microphones of the loudspeaker microphone combinations 217-220 disposed in the headrests as shown in FIG. 2).

Figure 4:
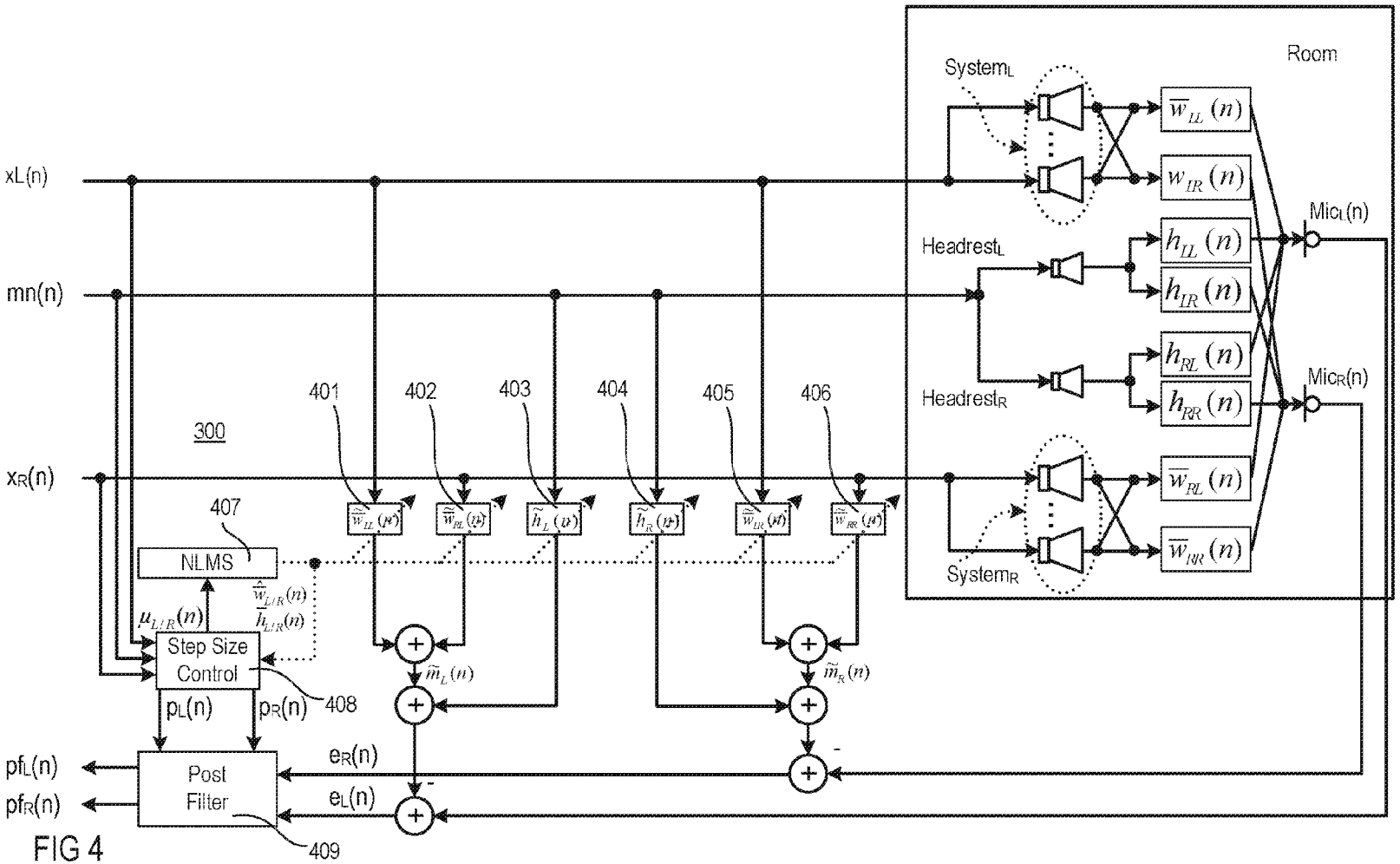
FIG. 4 is a block diagram depicting the structure of the AEC module shown in FIG. 3.

The upper right section of FIG. 4 illustrates the transfer functions $\overline{W}_{LL}(n)$, $\overline{W}_{RL}(n)$, $\overline{h}_{LL}(n)$, $\overline{h}_{LR}(n)$, $\overline{h}_{RL}(n)$, $\overline{h}_{RR}(n)$, $\overline{W}_{LR}(n)$, $\overline{W}_{RR}(n)$ of acoustic transmission channels between four systems loudspeakers such as loudspeakers 102*c* and

102*d* shown in FIG. 1 or the loudspeakers 205-208 shown in FIG. 2, and two loudspeakers disposed in the headrest of a particular seat (e.g., at position 204) such as loudspeakers 102*a* and 102*b* shown in FIG. 1 or the pair of loudspeaker in the loudspeaker-microphone combination 220 shown in FIG. 2 on one hand, and two microphones such as microphones 103*a* and 103*b* shown in FIG. 1 or the microphones in the loudspeaker-microphone combination 220 shown in FIG. 2 on the other hand. It is assumed that each of the loudspeakers present in the motor vehicle cabin broadcasts either the left or the right channel of the stereo signal x(n). However, in practice this is not the case since centrally disposed loudspeakers such as the center loudspeaker 211 or the subwoofer 212 in the arrangement shown in FIG. 2, commonly broadcast a mono signal m(n) which represents the sum of the left and right channels 1(*n*), r(n) of the stereo signal x(n) according to:

$$m(n) = \frac{1}{2}(l(n) + r(n)).$$

Each loudspeaker contributes to the microphone signal and the echo signal included therein in that the signals broadcasted by the loudspeakers are received by each of the microphones after being filtered with a respective room impulse response (RIR) and superimposed over each other to form a respective total echo signal. For example, the average RIR of the left channel signal $x_L(n)$ of the stereo signal x(n) from the respective loudspeaker to the left microphone can be described as:

$$\overline{w}_{LL}(n) = \frac{1}{L}\sum_{l=1}^{L} w_{lL}(n),$$

and for the left channel signal $x_L(n)$ of the studio signal x(n) from the respective loudspeaker to the right microphone as:

$$\overline{w}_{LR}(n) = \frac{1}{L}\sum_{l=1}^{L} w_{lR}(n).$$

Accordingly, the average RIR of the right channel signal $x_R(n)$ of the stereo signal x(n) from the respective loudspeaker to the right microphone can be described as:

$$\overline{w}_{RR}(n) = \frac{1}{R}\sum_{r=1}^{R} w_{rR}(n),$$

and for the right channel signal $x_R(n)$ of the studio signal x(n) from the respective loudspeaker to the left microphone as:

$$\overline{w}_{RL}(n) = \frac{1}{R}\sum_{r=1}^{R} w_{rL}(n).$$

Additionally, masking signal mn(n) generates an echo which is also received by the two microphones.

A typical situation, in which a speaker sits on one of the rear seats and a listener sits on one of the front seats and the listener should not understand what the speaker on the rear seat says and masking sound is radiated from loudspeakers in the headrest of the listener's seat, is depicted in FIG. 4. The masking sound is broadcasted only by the loudspeakers in the headrests of the listener's seat and no other loudspeakers are involved in masking so that the average RIR $\overline{h}_L(n)$ with respect to the left microphone is $$\overline{h}_L(n) = \frac{1}{2}(h_{LL}(n) + h_{RL}(n)),$$

and the average RIR $\overline{h}_{RL}(n)$ with respect to the right microphone is $$\overline{h}_R(n) = \frac{1}{2}(h_{LR}(n) + h_{RR}(n)).$$

The following description is based on the assumption that the speaker sits on the right rear seat and the listener on the left front seat (driver's seat), wherein the listener should not understand what the speaker says. Any other constellations of speaker and listener positions are applicable as well. Under the above circumstances the total echo signals $\text{Echo}_L(n)$ and $\text{Echo}_R(n)$ received by the left and right microphones are as follows:

$$\text{Echo}_L(n)=x_L(n)*\overline{w}_{LL}(n)+x_R(n)*\overline{w}_{RL}(n)+mn(n)*\overline{h}_L(n),$$

and $$\text{Echo}_R(n)=x_L(n)*\overline{w}_{LR}(n)+x_R(n)*\overline{w}_{RR}(n)+mn(n)*\overline{h}_R(n),$$

wherein "*" is a convolution operator.

In case of K=3 uncorrelated input signals $x_L(n)$, $x_R(n)$ and mn(n) and I=2 microphones (in the headrest), K·I=6 different independent adaptive systems are established, which may serve to estimate the respective RIRs $\overline{w}_{LL}(n)$, $\overline{w}_{LR}(n)$, $\overline{w}_{RL}(n)$ $\overline{w}_{RR}(n)$, $\overline{h}_L(n)$, and $\overline{h}_R(n)$, i.e., to generate RIR estimates $\tilde{\overline{w}}_{LL}(n)$, $\tilde{\overline{w}}_{LR}(n)$, $\tilde{\overline{w}}_{RL}(n)$, $\tilde{\overline{w}}_{RR}(n)$, $\tilde{\overline{h}}_L(n)$, and $\tilde{\overline{h}}_R(n)$ as shown in FIG. 4.

The echoes of the useful signal as recorded by the left microphone which outputs signal $m_L(n)$ and the right microphone which outputs signal $m_L(n)$, serve as first output signals of the AEC module 300 and can be estimated as follows:

$$\tilde{m}_L(n)=x_L(n)\cdot\tilde{\overline{w}}_{LL}(n)+x_R(n)\cdot\tilde{\overline{w}}_{RL}(n),$$

$$\tilde{m}_R(n)=x_L(n)\cdot\tilde{\overline{w}}_{LR}(n)+x_R(n)\cdot\tilde{\overline{w}}_{RR}(n).$$

The error signals $e_L(n)$, $e_R(n)$ serve as second output signals of the AEC module 300 and can be calculated as follows:

$$e_L(n)=\text{Mic}_L(n)-(x_L(n)*\tilde{\overline{w}}_{LL}(n)+x_R(n)*\tilde{\overline{w}}_{RL}(n)+mn(n)*\tilde{\overline{h}}_L(n)),$$

$$e_R(n)=\text{Mic}_R(n)-(x_L(n)*\tilde{\overline{w}}_{LR}(n)+x_R(n)*\tilde{\overline{w}}_{RR}(n)+mn(n)*\tilde{\overline{h}}_R(n)).$$

From the above equations it can be seen that the error signals $e_L(n)$ and $e_R(n)$ ideally contain only potentially existing noise or speech signal components. The error signals $e_L(n)$ and $e_R(n)$ are supplied to the post filter module 409, which outputs third output signals $pf_L(n)$ and $pf_R(n)$ of the AEC module 300 which can be described as:

$$pf_L(n)=e_L(n)*p_L(n), \text{ and}$$

$$pf_R(P)=e_R(n)*p_R(n)$$

The adaptive post filter 409 is operated to suppress potentially residual echoes present in the error signals $e_L(n)$ and $e_R(n)$. The residual echoes are convolved with coefficients $p_L(n)$ and PR(n) of the post filter 409, which serves as a type of time invariant, spectral level balancer. In addition to the coefficients $p_L(n)$ and $p_R(n)$ of the adaptive post filter the adaptive step size $\hat{\mu}_{L/R}(n)$, which are in the present example the adaptive adaptation step sizes $\mu_L(n)$ and $\mu_R(n)$, are calculated in step size control module 408 based on the input signals $x_L(n)$, $x_R(n)$, mn(n), $\tilde{\bar{w}}_{LL}(n)$, $\tilde{\bar{w}}_{LR}(n)$, $\tilde{\bar{w}}_{RL}(n)$, $\tilde{\bar{w}}_{RR}(n)$, $\tilde{h}_L(n)$, and $\tilde{h}_R(n)$. As already mentioned above, alternatively signal processing within the AEC module may be in the frequency domain instead of the time domain. The signal processing procedures can be described as follows:

Input signals $X_k(e^{j\Omega},n)$:

$$X_k(e^{j\Omega},n)=\mathrm{FFT}\{x_k(n)\},$$

wherein $$x_k(n)=[x_k(nL-N+1), \ldots, x_k(nL+L-1)]^T,$$

$$x_k(n)=[x_0(n),x_1(n),x_2(n)]=[mn(n),x_L(n),x_R(n)],$$

L is the block length, N is length of the adaptive filter, M=N+L−1 is the length of the fast Fourier transformation (FFT), k=K−1, and K is the number of uncorrelated input signals.

Echo signals $y_i(n)$:

$$y_{i,Comp}(n)=\Re\{\mathrm{IFFT}\{\Sigma_{k=0}^{K-1}X_k(e^{j\Omega},n)\tilde{W}_{k,i}(e^{j\Omega},n)\}\},$$

wherein $$y_i(n)=[y_{i,Comp}(M-L+1), \ldots, y_{i,Comp}(M)]^T,$$

which is a vector that includes the final L elements of $y_{i,Comp}(M)$, I=[0, . . . , I−1], and $$\tilde{W}_{k,i}(e^{j\Omega},n)=\begin{bmatrix}\tilde{W}_{0,0}(e^{j\Omega},n) & \tilde{W}_{0,1}(e^{j\Omega},n)\\ \tilde{W}_{1,0}(e^{j\Omega},n) & \tilde{W}_{1,1}(e^{j\Omega},n)\\ \tilde{W}_{2,0}(e^{j\Omega},n) & \tilde{W}_{2,1}(e^{j\Omega},n)\end{bmatrix}=\begin{bmatrix}\tilde{\bar{H}}_L(e^{j\Omega},n) & \tilde{\bar{H}}_R(e^{j\Omega},n)\\ \tilde{W}_{L,L}(e^{j\Omega},n) & \tilde{W}_{L,R}(e^{j\Omega},n)\\ \tilde{W}_{R,L}(e^{j\Omega},n) & \tilde{W}_{R,R}(e^{j\Omega},n)\end{bmatrix}.$$

Error signals $e_i(n)$:

$$e_i(n)=d_i(n)=y_i(n),$$

$$e_i(n)=[e_0(n), e_1(n)]=[e_L(n), e_R(n)], \text{ wherein}$$

$$d_i(n)=[d_0(n), d_1(n)]=[d_L(n), d_R(n)],$$

$$y_i(n)=[y_0(n), y_1(n)]=[y_L(n), y_R(n)],$$

$$E_i(e^{j\Omega},n)=FFT\left\{\begin{bmatrix}0\\ e_m(n)\end{bmatrix}\right\},$$

0 is a zero column vector with length M/2, and $e_m(n)$ is an error signal vector with length M/2.

Input signal energy $p_i(e^{j\Omega}, n)$:

$$p_i(e^{j\Omega},n),$$

$$p_i(e^{j\Omega_m},n)=\alpha p_i(e^{j\Omega_m},n-1)+(1-\alpha)\Sigma_{k=0}^{K-1}|X_k(e^{j\Omega_m},n)|,$$

$$p_i(e^{j\Omega_m},n)=[p_0(e^{j\Omega_m},n),p_1(e^{j\Omega_m},n)],[p_L(e^{j\Omega_m},n),p_R(e^{j\Omega_m},n)],$$

$$p_i(e^{j\Omega_m},n)=\max\{p_{Min},p_i(e^{j\Omega_m},n)\},$$

α is a smoothing coefficient for the input signal energy and $p_{Min}$ is a valid minimal value of the input signal energy.

Adaption step size $\mu_i(e^{j\Omega},n)$ [part 1]:

$$\mu_i(e^{j\Omega_m},n)=\frac{\mu_i(e^{j\Omega_m},n-1)}{p_i(e^{j\Omega_m},n)},$$

$$\mu_i(e^{j\Omega_m},n)=[\mu_0(e^{j\Omega_m},n),\ \mu_1(e^{j\Omega_m},n)]=[\mu_L(e^{j\Omega_m},n),\mu_R(e^{j\Omega_m},n)],$$

and $$\mu_i(e^{j\Omega_m},n)=[\mu_i(e^{j\Omega_0},n), \ldots, \mu_i(e^{j\Omega_{M-1}},n)].$$

Adaption:

$$W_{k,i}(e^{j\Omega},n)=\tilde{W}_{k,i}(e^{j\Omega},n-1)+\mathrm{diag}\{\mu_i(e^{j\Omega},n)\}\mathrm{diag}\{X_k^*(e^{j\Omega},n)\}E_i(e^{j\Omega},n),$$

wherein $W_{k,i}$ $(e^{j\Omega}, n)$ are the coefficients of the adaptive without constraint, $\tilde{W}_{k,i}(e^{j\Omega}, n)$ are the coefficients of the adaptive with constraint, diag{x} is the diagonal matrix of vector x, and x is the conjugate complex value of the (complex) value x.

Constraint:

$$\tilde{W}_{k,i}(e^{j\Omega},n)=FFT\left\{\begin{bmatrix}\tilde{w}_{k,i}(n)\\ 0\end{bmatrix}\right\},$$

wherein $\tilde{w}_{k,i}(n)$ is a vector with the first M/2 elements of $\Re\{\mathrm{IFFT}\{W_{k,i}(e^{j\Omega}, n+1)\}\}$.

System distance $G_i(e^{j\Omega}, n)$:

$$G_i(e^{j\Omega_m},n)=G_i(e^{j\Omega_m},n-1)(1-\mu_i(e^{\Omega_m},n))+\Delta_i(e^{\Omega_m},n),$$

$$\Delta_i(e^{j\Omega_m},n)=C\Sigma_{k=0}^{K}|\tilde{W}_{k,i}(e^{\Omega_m},n)|^2,$$

$$G_i(e^{j\Omega},n)=[G_0(e^{j\Omega},n),G_1(e^{j\Omega},n)]=[G_L(e^{j\Omega},n),G_R(e^{j\Omega},n)],$$

$$\Delta_i(e^{j\Omega},n)=[\Delta_0(e^{j\Omega},n),\Delta_1(e^{j\Omega},n)]=[\Delta_L(e^{j\Omega},n),\Delta_R(e^{j\Omega},n)],$$

wherein

C is the constant which determines the sensitivity of DTD.

Adaption step size $\mu_i(e^{j\Omega},n)$ [part 2]:

$$\mu_i(e^{j\Omega_m},n)=\frac{G_i(e^{j\Omega_m},n)\sum_{k=0}^{K}\left|X_k(e^{j\Omega_m},n)^2\right|}{|E_i(e^{j\Omega_m},n)|^2},$$

$$\mu_i(e^{j\Omega_m},n)=\max\{\mu_{Min},\mu_i(e^{j\Omega_m},n)\},$$

$$\mu_i(e^{j\Omega_m},n)=\min\{\mu_{Max},\mu_i(e^{j\Omega_m},n)\},$$

wherein m=[0, . . . , M−1], $P_i(e^{j\Omega}, n)$, $\mu_{Max}$ is the upper permissible limit and $\mu_{Min}$ is the lower permissible limit of $\mu_i$ $(e^{j\Omega_m}, n)$.

Adaptive post filter $P_i$ $(e^{j\Omega_m}, n)$:

$$P_i(e^{j\Omega_m},n)=1-\mu(e^{j\Omega_m},n),$$

$$\mathrm{PF}_i(e^{j\Omega_m},n)=P_i(e^{j\Omega_m},n)E_i(e^{j\Omega_m},n),$$

$$P_i(e^{j\Omega_m},n)=\max\{P_{Min},P_i(e^{j\Omega_m},n)\},$$

$$P_i(e^{j\Omega_m},n)=\min\{P_{Max},P_i(e^{j\Omega_m},n)\},$$

wherein $P_{Max}(e^{j\Omega},n)=(e^{j\Omega_m},n)$ is the upper permissible limit of $P_i(e^{j\Omega_m},n)$, $P_{Min}(e^{j\Omega},n)=(e^{j\Omega_m},n)$ is the lower permissible limit of $P_i(e^{j\Omega_m},n)$, $P_i(e^{j\Omega},n)=[P_0(e^{j\Omega},n),P_1(e^{j\Omega},n)]=[P_L(e^{j\Omega},n),P_R(e^{j\Omega},n)]$, and $PF_i(e^{j\Omega},n)=[PF_0(e^{j\Omega},n),PF_1(e^{j\Omega},n)]=[PF_L(e^{j\Omega},n),PF_R(e^{j\Omega},n)]$.

Thus, the output signals of the AEC module can be described as follows:

Echoes $\tilde{M}_L(e^{j\Omega}, n)$, $\tilde{M}_R(e^{j\Omega}, n)$ of the useful signals are calculated according to $$\tilde{M}_L(e^{j\Omega},n)=X_L(e^{j\Omega},n)+\overline{\tilde{W}}_{LL}(e^{j\Omega},n)+X_R(e^{j\Omega},n)\overline{\tilde{W}}_{RL}(e^{j\Omega},n), \text{ and}$$

$$\tilde{M}_R(e^{j\Omega},n)=X_L(e^{j\Omega},n)\overline{\tilde{W}}_{LR}(e^{j\Omega},n)+X_R(e^{j\Omega},n)\overline{\tilde{W}}_{RR}(e^{j\Omega},n).$$

Calculating in the spectral domain the useful signal echoes contained in the microphone signals allows for determining what intensity and coloring the desired signals have at the locations where the microphones are disposed, which are the locations where the speech of the near-speaker should not be understood (e.g., by a person sitting at the driver position). This information is important for evaluating whether the present useful signal (e.g., music) at a discrete point in time n is sufficient to mask an possibly occurring signal from the near-speaker so that the speech signal cannot be heard at the listener's position e.g., driver position). If this is true no additional masking signal mn(n) needs to be generated and radiated to or at the driver position.

Error Signals $E_L(e^{j\Omega}, n)$, $E_R(e^{j\Omega}, n)$:

The error signals $E_L(e^{j\Omega}, n)$, $E_R(e^{j\Omega}, n)$ include, in addition to minor residual echoes, an almost pure background noise signal and the original Signal from the close speaker.

Output Signals $PF_L(e^{j\Omega}, n)$, $PF_R(e^{j\Omega}, n)$ of the Adaptive Post Filter:

In contrast to the error signals $E_L(e^{j\Omega}, n)$, $E_R(e^{j\Omega}, n)$ the output signals $PF_L(e^{j\Omega}, n)$, $PF_R(e^{j\Omega}, n)$ of the adaptive post filter contain no significant residual echoes due the time-invariant, adaptive post filtering which provides a kind of spectral level balancing. Post filtering has almost no negative influence on the speech signal components of the near-speaker contained in the output signals $PF_L(e^{j\Omega}, n)$, $PF_R(e^{j\Omega}, n)$ of the adaptive post filter but rather on the also contained background noise. The coloring of the background noise is modified by post filtering, at least when active useful signals are involved, so that the background noise level is finally reduced and, thus, the modified background noise cannot serve as a basis for an estimation of the background noise due to the modification. For this reason, the error signals $E_L(e^{j\Omega}, n)$, $E_R(e^{j\Omega}, n)$ may be used to estimate the background noise $\tilde{N}(e^{j\Omega}, n)$, which may form basis for the evaluation of the masking effect provided by the (stereo) background noise.

Figure 5:
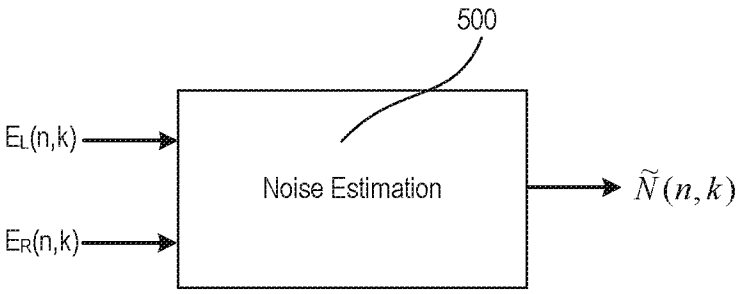
FIG. 5 is a schematic diagram illustrating the inputs and outputs of a noise estimation module applicable in the arrangement shown in FIG. 1.

FIG. 5 depicts a noise estimation module 500, which may be used as noise estimation module 113 in the arrangement shown in FIG. 1. For better clarity, FIG. 5 depicts only the signal processing module for the estimation of the background noise, which corresponds to the mean value of the portions of background noise recorded by the left and right microphones (e.g., microphones 103*a* and 103*b*), with its input and output signals. Noise estimation module 500 receives input signals, which are error signals $E_L(n, k)$, $E_R(n, k)$, and an output signal, which is an estimated noise signal $\tilde{N}(n, k)$.

Figure 6:
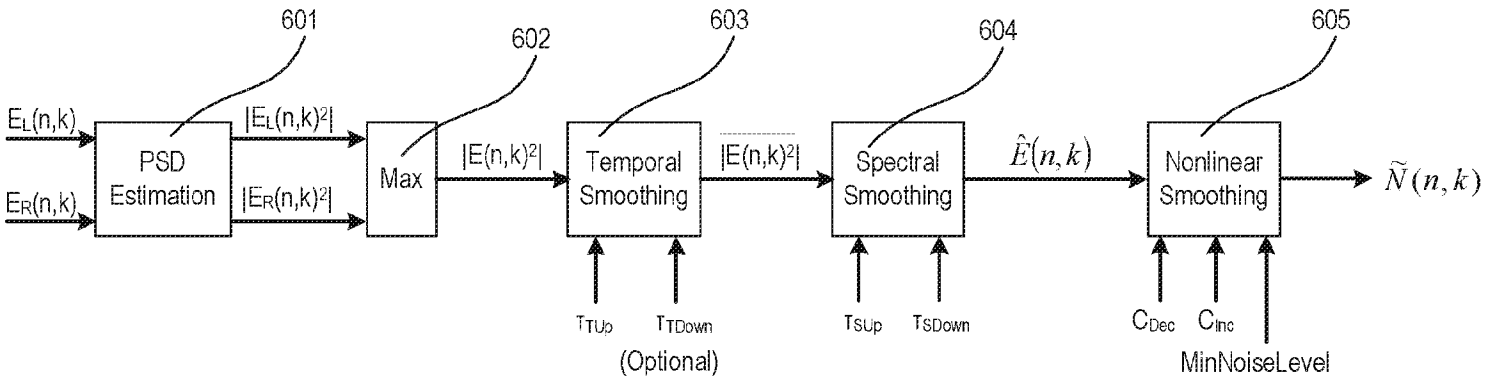
FIG. 6 is a block diagram depicting the structure of the noise estimation module shown in FIG. 5.

FIG. 6 illustrates in detail the structure of noise estimation module 500. Noise estimation module 500 includes a power spectral density (PSD) estimation module 601 which receives the error signals $E_L(n, k)$, $E_R(n, k)$ and calculates power spectral densities $|E_L(n, k)^2|$, $|E_R(n, k)^2|$ thereof, and a maximum power spectral density detector module 602 which detects a maximum power spectral density value $|E(n, k)^2|$ of the calculated power spectral densities $|E_L(n, k)^2|$, $|E_R(n, k)^2|$. Noise estimation module 500 further includes an optional temporal smoothing module 603 which smoothes over time the maximum power spectral density $|E(n, k)^2|$ received from the maximum power spectral density detector module 602, to provide a temporally smoothed maximum power spectral density $\overline{|E(n,k)^2|}$, a spectral smoothing module 604 which smoothes over frequency the maximum power spectral density $|E(n, k)^2|$ received from the temporal smoothing module 603 to provide a spectrally smoothed maximum power spectral density $\hat{E}(n, k)$, and a non-linear smoothing module 605 which smoothes in a non-linear fashion the spectrally smoothed maximum power spectral density $\hat{E}(n, k)$ received from the spectral smoothing module 604 to provide a non-linearly smoothed maximum power spectral density, which is the estimated noise signal $\tilde{N}(n, k)$. Temporal smoothing module 603 may further receive smoothing coefficients $\tau_{TUp}$ and $\tau_{TDown}$. Spectral smoothing module 604 may further receive smoothing coefficients $\tau_{SUp}$ and $\tau_{SDown}$. Non-linear smoothing module 605 may further receive smoothing coefficients $C_{Dec}$ and $C_{Inc}$, and a minimum noise level setting MinNoiseLevel.

The sole input signals of noise estimation module 500 are the error signals $E_L(n,k)$ and $E_R(n,k)$ from the two microphones coming from the AEC module. Why precisely these signals are being used for the estimation was explained further above. From FIG. 6 it can be seen how the two error signals $E_L(n,k)$ and $E_R(n,k)$ are processed to calculate the estimated noise signal $\tilde{N}(n, k)$ which corresponds to the mean value of the background noise recorded by both microphones.

The power of each input signal, error signals $E_L(n,k)$ and $E_R(n,k)$ is determined by calculating (estimating) their power spectral densities $|E_L(n, k)^2|$, $|E_R(n, k)^2|$ and then formulating their maximum value, maximum power spectral density $|E(n, k)^2|$. Optionally, maximum power spectral density $|E(n, k)^2|$ may be smoothed over time, in which case the smoothing will depend on whether the maximum power spectral density $|E(n, k)^2|$ is rising or falling. If the maximum power spectral density is rising, the smoothing coefficient $\tau_{TUp}$ is applied, if it is falling the smoothing coefficient $\tau_{TDown}$ is used. Another option is to smooth the maximum power spectral density $|E(n, k)^2|$ over time, which then serves as the input signal for the spectral smoothing module 604, where the signal undergoes spectral smoothing. In the spectral smoothing module 604 it is then decided whether the smoothing is to be carried out from low to high ($\tau_{SUp}$ active), from high to low ($\tau_{SDown}$ active), or whether the smoothing should take place in both directions. A spectral smoothing in both directions, which is carried out using the same smoothing coefficient ($\tau_{SUp}=\tau_{SDown}$), may be appropriate when a spectral bias should be prevented. As it may be desirable to estimate the background noise as authentically as possible, spectral distortions may be inadmissible, necessitating in this case a spectral smoothing in both directions.

Then, spectrally smoothed maximum power spectral density $\hat{E}(n, k)$ is fed into the non-linear smoothing module 605. In the non-linear smoothing module 605, any abrupt disruptive noise still remaining in the spectrally smoothed maximum power spectral density $\hat{E}(n, k)$, such as conversation, the slamming of doors or tapping on the microphone, is suppressed.

Figure 7:
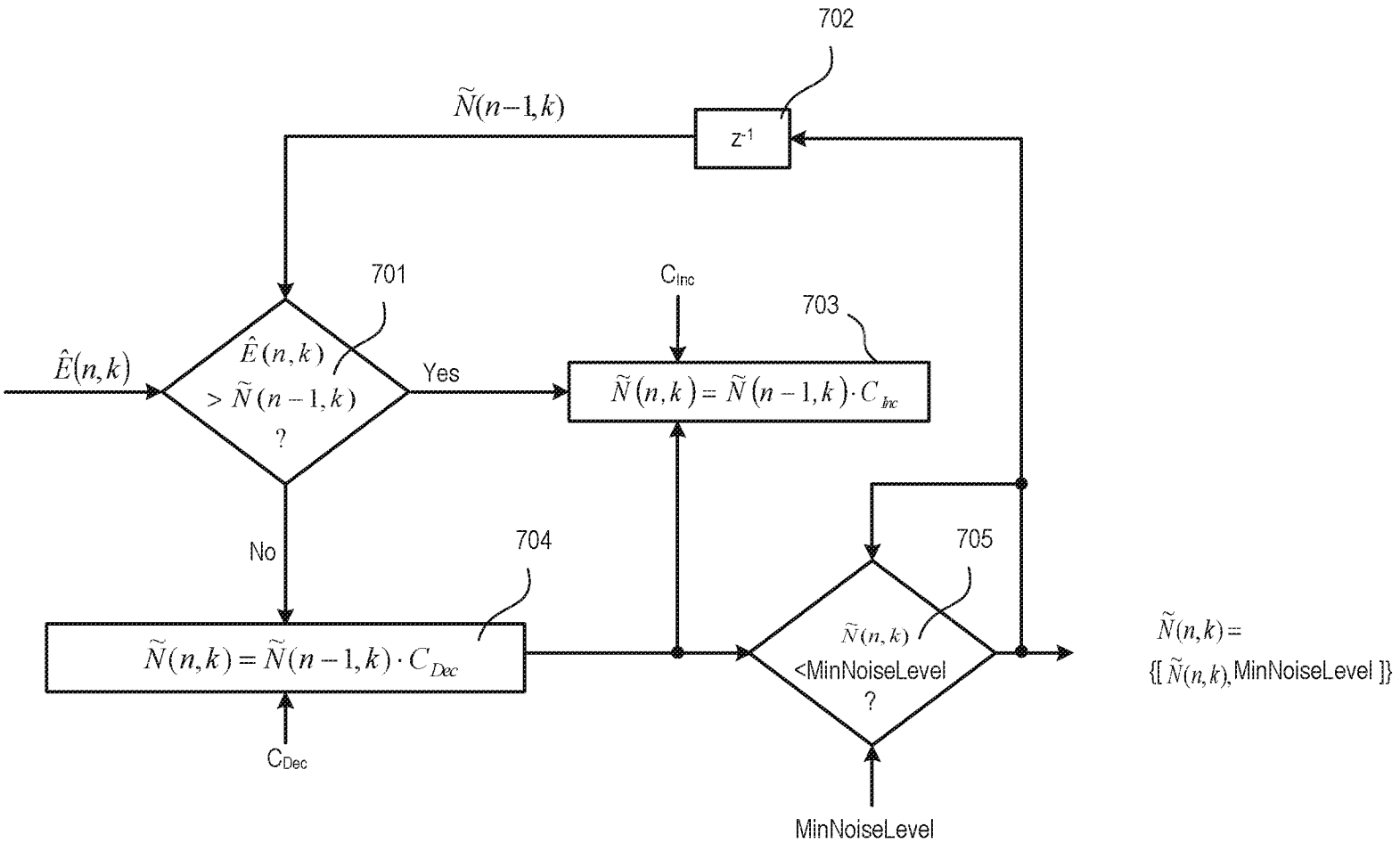
FIG. 7 is a schematic diagram illustrating the inputs and outputs of a non-linear smoothing module applicable in the noise estimation module shown in FIG. 6.

The non-linear smoothing module 605 in the arrangement shown in FIG. 6 may have an exemplary signal flow structure as shown in FIG. 7. Abrupt disruptive noise can be suppressed by performing a ongoing comparison (step 701) between the individual spectral lines (K-Bins) of the input signal, the spectrally smoothed maximum power spectral density $\hat{E}(n, k)$, and the estimated noise signal $\tilde{N}(n-1, k)$, itself delayed by one time factor n in a step 702. If the input signal, the spectrally smoothed maximum power spectral density $\hat{E}(n, k)$, is larger than the delayed output signal, the delayed estimated noise signal $\tilde{N}(n-1, k)$, then a so-called increment event is triggered (step 703). In this case the delayed estimated noise signal $\tilde{N}(n-1, k)$ will be multiplied with increment parameter, which has a factor $C_{Inc}>1$, resulting in a rise of the estimated noise signal $\tilde{N}(n, k)$ in comparison to the delayed estimated noise signal $\tilde{N}(n-1, k)$. In the opposing case, i.e., if the spectrally smoothed maximum power spectral density $\hat{E}(n, k)$ is smaller than the delayed estimated noise signal $\tilde{N}(n-1, k)$, then a so-called decrement event is triggered (step 704). Here the delayed estimated noise signal is multiplied by $C_{Dec}<1$, which results in the estimated noise signal $\tilde{N}(n, k)$ being smaller than the delayed estimated noise signal $\tilde{N}(n-1, k)$. Then, the resulting estimated noise signal $\tilde{N}(n, k)$ is compared (in a step 705) with a threshold MinNoiseLevel and, if it lies below the threshold, the estimated noise signal $\tilde{N}(n, k)$ is then limited to this value according to:

$$\tilde{N}(n,k)=\{[\tilde{N}(n,k),\text{MinNoiseLevel}]\}.$$

If the echoes of the useful signals, estimations of which may be taken directly from the AEC module, or the estimated background noise, as derived from the noise estimation module, do not provide adequate masking of the speech signal in the region in which the conversation should not be understood, then a masking signal mn(n) is calculated. For this, the speech signal component $\tilde{S}(n, k)$ within the microphone signal is estimated, as this serves as the basis for the generation of the masking signal mn(n). One possible method for determining the speech signal component $\tilde{S}(n, k)$ will be described below.

Figure 8:
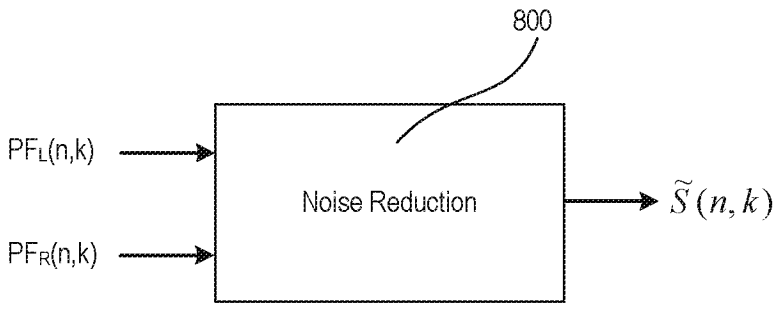
FIG. 8 is a schematic diagram illustrating the inputs and outputs of a noise reduction module applicable in the arrangement shown in FIG. 1.
Figure 9:
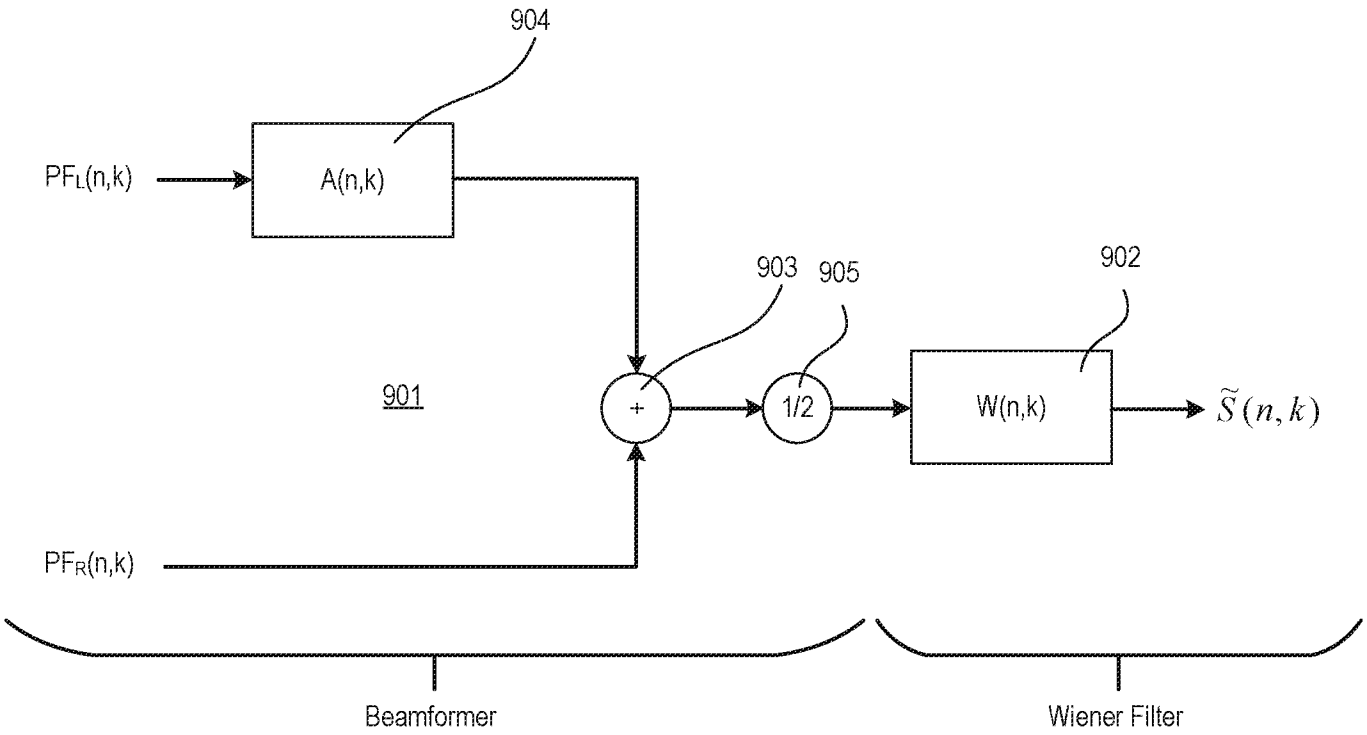
FIG. 9 is a block diagram depicting the structure of the noise reduction module shown in FIG. 8.

FIG. 8 depicts a noise reduction module 800 which may be used as noise reduction module 114 in the arrangement shown in FIG. 1. Noise reduction module 800 receives input signals, which are the output signals $PF_L(n, k)$, $PF_R(n, k)$ of the post filter 409 shown in FIG. 4, and an output signal, which is the estimated speech signal $\tilde{S}(n, k)$. FIG. 9 illustrates in detail the noise reduction module 800 which includes a beamformer 901 and a Wiener filter 902. In the beamformer 901, the signals $PF_L(n, k)$, $PF_R(n, k)$ are subtracted from each other by a subtractor 903 and before this subtraction takes place, one of the signals $PF_L(n, k)$, $PF_R(n, k)$, e.g., signal $PF_L(n, k)$, is passed through a delay element 904 to delay signal $PF_L(n, k)$ compared to signal $PF_R(n, k)$. The delay element 904 may be, for example, an all-pass filter or time delay circuit. The output of subtractor 903 is passed through a scaler 905 (e.g., performing a division by 2) to Wiener filter 902 which provides the estimated speech signal $\tilde{S}(n, k)$.

As may be deducted from FIGS. 8 and 9, the extraction of the speech signal $\tilde{S}(n, k)$ contained in the microphones is based on the output signals from the adaptive post filters signals $PF_L(e^{j\Omega}, n)$, $PF_R(e^{j\Omega}, n)$, which, in FIGS. 8 and 9, are designated as signals $PF_L(n, k)$, $PF_R(n, k)$. As mentioned above, characteristic for the signals $PF_L(n, k)$ and $PF_R(n, k)$, i.e., $PF_L(e^{j\Omega}, n)$ and $PF_R(e^{j\Omega}, n)$, is the fact that they undergo a further echo reduction by the adaptive post filters, as well as a substantial, implicit ambient noise reduction, without causing permanent distortion to the speech signal they also contain. Noise reduction module 800 suppresses, or ideally eliminates the ambient noise components remaining in the signals $PF_L(e^{j\Omega}, n)$ and $PF_R(e^{j\Omega}, n)$, and ideally only the desired speech signal $\tilde{S}(n, k)$ will remain. As can be seen in FIG. 9, in order to achieve this end the process is divided up into two parts.

As the first part a beamformer is used, which essentially amounts to a delay and sum beamformer, in order to take advantage of its spatial filter effect. This effect is known to bring about a reduction in ambient noise, (depending on the distance $d_{Mic}$ between the microphones), predominantly in the upper spectral range. Instead of compensating for the delay, as is typically done when a delay and sum beamformer is used, here a time variable, spectral phase correction is carried out with the aid of an all-pass filter A(n,k), calculated from the input signals according to the following equation:

$$A(n, k) = \frac{PF_R(n, k)PF_L^*(n, k)}{|PF_L(n, k)||PF_R(n, k)|}.$$

Before performing the calculation it should be ensured that both channels have the same phase in relation to the speech signal. Otherwise a partially destructive overlapping of speech signal components will lead to the unwanted suppression of the speech signal, lowering the quality of the signal-to-noise ratio (SNR). The following signal is provided at the output of the all-pass filter:

$$PF_L(n,k)A(n,k)=|PF_L(n,k)|e^{j\measuredangle\{PF_R(n,k)\}}.$$

When employing the phase correction segment A(n,k) only the magnitude frequency response value of the signal-supplying microphone (in this case the signal $|PF_L(n,k)|$, originating in the left microphone) is provided at the output, although the angular frequency response value from the other microphone (here $\measuredangle\{PF_R(n,k)\}$, from the right microphone) is used. In this manner, coherent incident signal components, such as those of the speaker, remain untouched, whereas other incoherent incident sound elements, such as ambient noise, are reduced in the calculation. The maximum attenuation that can generally be reached using a delay and sum beamformer is 3 dB, whereas, at a microphone distance of $d_{Mic}=0.2$ [m] (roughly corresponding to the distance to the microphone in a headrest), and a sound velocity of $c_{\Theta\text{-}20^\circ C.}=343$ ms, this can only be achieved at or above a frequency of:

$$f = \frac{c}{2d_{Mic}} = 857{,}5 \text{ [Hz]},$$

which illustrates the calculation of the cutoff frequency f, beyond which point the noise-suppressing effect from the spatial filtering of a non-adaptive beamformer with two microphones, positioned at the distance dMic, becomes apparent. Because of the fact that ambient noise in a motor vehicle lies in the dark red spectral segments, meaning that its components are predominantly made up of sound with a lower frequency, (in the range of approximately f<1 kHz), the noise suppression of the beamformer, that is, its spacial filtering, which only affects high-frequency noise, can obviously only suppress certain parts of the ambient noise, such as the sounds coming from the ventilator or an open window.

The second part of the noise suppression that takes place in the noise reduction module 800 is performed with the aid of an optimum filter, the Wiener Filter with a transfer function W(n,k), which carries out the greater portion of the noise reduction, in particular, as mentioned above, in motor vehicles. The transfer function W(n,k) of the Wiener Filter can be calculated as follows:

$$W(n,k) = \frac{|PF_L(n,k)PF_R^*(n,k)|}{\frac{1}{2}(|P_{FL}(n,k)^2| + |PF_R(n,k)^2|)},$$

wherein $W(n, k)=\max\{W_{Min}, W(n, k)\}$, $W(n, k)=\min\{W_{Max}, W(n, k)\}$, $W_{Max}$=upper admissable limit of W(n, k), $W_{Min}$=lower admissable limit of W(n, k).

From the above equation it can be seen that the Wiener Filter's transfer function W(n,k) should also be restricted and that the limitation to the minimally admissible value is of particular importance. If transfer function W(n,k) is not restricted to a lower limit of $W_{Min}\approx-12$ dB, . . . , −9 dB, the result will be the formation of so-called "musical tones", which will not necessary have an impact on the masking algorithm, but will at least then become important when one wishes to provide the extracted speech signal, for example, when applying a speakerphone algorithm. For this reason, and because it does not negatively affect the Sound Shower algorithm, the restriction is provided at this stage. The output signal S(n,k) of the noise reduction module 800 may be calculated according to the following equation:

$$\tilde{S}(n,k) = \frac{1}{2}(PF_L(n,k)A(n,k) + PF_R(n,k)W(n,k)).$$

Figure 10:
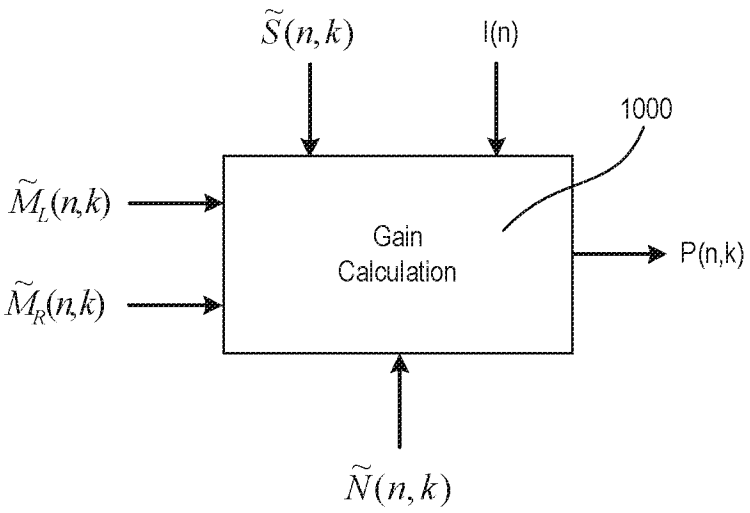
FIG. 10 is a schematic diagram illustrating the inputs and outputs of a gain calculation module applicable in the arrangement shown in FIG. 1.

FIG. 10 depicts a gain calculation module 1000 which may be used as gain calculation module 115 in the arrangement shown in FIG. 1. Gain calculation module 1000 receives the estimated useful signal echoes $\tilde{M}_L(n, k)$ and $\tilde{M}_L(n, k)$, the estimated speech signal $\tilde{S}(n, k)$, a weighting signal I(n), and the estimated noise signal $\tilde{N}(n, k)$, and provides the power spectral density P(n,k) of the near-speaker's speech signal.

Figure 11:
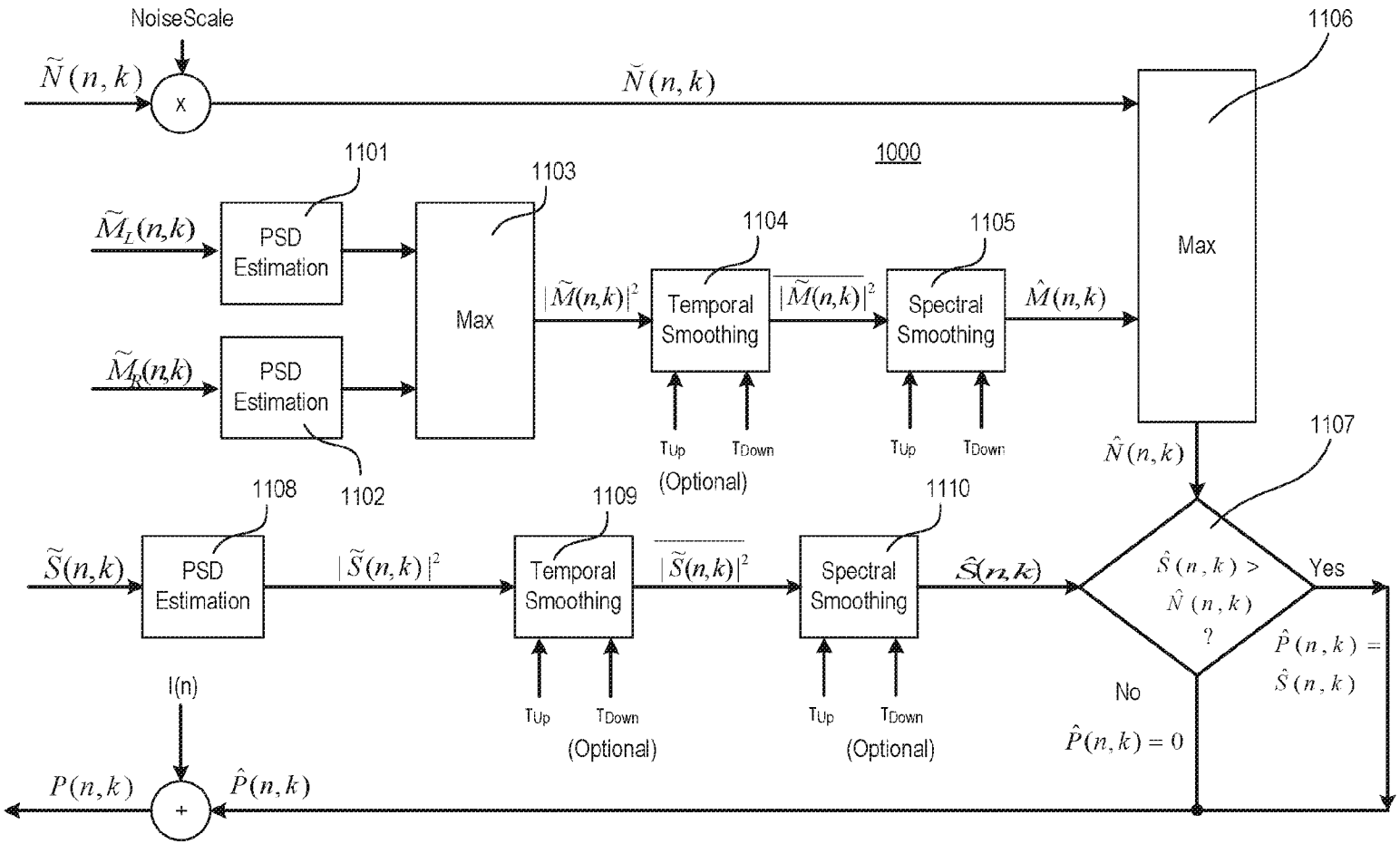
FIG. 11 is a block diagram depicting the structure of the gain calculation module shown in FIG. 10.

FIG. 11 illustrates in detail the structure of gain calculation module 1000. In the gain calculation module 1000, the power spectral density P(n,k) of the near-speaker is calculated based on the estimated useful signal echoes $\tilde{M}_L(n, k)$, $\tilde{M}_R(n, k)$, the estimated ambient noise signal $\tilde{N}(n, k)$, the estimated speech signal $\tilde{S}(n, k)$, and the weighting signal I(n). For this the power spectral densities of the useful signals $|\tilde{M}_L(n, k)^2|$, $|\tilde{M}_R(n, k)^2|$ are calculated in PSD estimation modules 1101 and 1102, respectively, and then its maximum value $|\tilde{M}(n, k)^2|$ is determined in a maximum detector module 1103. The maximum value $|\tilde{M}(n, k)^2|$ may be (temporally and spectrally) smoothed in the same way as described earlier for the ambient noise signal by applying smoothing filters 1104 and 1105 using, for example, the same time constants $\tau_{Up}$ and $\tau_{Down}$. The maximum value $\hat{N}(n, k)$ is then calculated in another maximum detector module 1106 from the smoothed useful signal $\hat{M}(n, k)$ and the estimated ambient noise signal $\tilde{N}(n, k)$, scaled by the factor NoiseScale. The maximum value $\hat{N}(n, k)$ is then passed on to a comparison module 1107 where it is compared with the estimated speech signal $\hat{S}(n, k)$, which may be derived from the estimated speech signal $\tilde{S}(n, k)$ by calculating the PSD in a PSD estimation module 1108, smoothed in a similar manner as the useful signal, by way of an optional temporal smoothing filter 1109 and an optional spectral smoothing filter 1110.

Applying the scaling factor NoiseScale, with Noise Scale ≥1, for the weighting of the estimated ambient noise signal $\tilde{N}(n, k)$, produces the following results: The higher the scaling factor NoiseScale chosen, the lesser the risk of the ambient noise mistakenly being estimated as speech. The sensitivity of the speech detector, however, is reduced in the process, increasing the probability that the speech elements actually contained in the microphone signals will not be correctly detected. Speech signals at lower levels thereby run a greater risk of not generating a masking noise.

As already mentioned, the time variable spectra of the maximum value $\hat{N}(n, k)$ and the estimated speech signal $\hat{S}(n, k)$ are passed on to the comparison module 1107 where a comparison is made between the spectral progression of the estimated speech signal $\hat{S}(n, k)$ and the spectrum of the estimated ambient noise $\hat{N}(n, k)$.

The estimated speech signal $\hat{S}(n, k)$ is only used as the output signal $\hat{P}(n, k)$, so that $\hat{P}(n, k)=\hat{S}(n, k)$, when it is larger than the maximum value $\hat{N}(n, k)$, meaning larger than the maximum value of the useful signal's echo $\hat{M}(n, k)$ and the background noise $\hat{N}(n, k)$. Otherwise, no output signal $\hat{P}(n, k)$ will be formed, i.e., $\hat{P}(n, k)=0$ will be used as an output signal. Putting it in other words: Only in those cases in which the ambient noise signal and/or the music signal (useful signal echo) is (are) insufficient for a "natural" masking of the existing speech signal will an additional masking noise mn(n) be generated and its frequency response value P(n,k) be determined. The output signal $\hat{P}(n, k)$ of the comparison module 1107 may not be directly applied here, as at this point it is not yet known from which speaker the signal originates. Only if the signal originates from the near-speaker, sitting, for example, on the right back seat, may the masking signal mn(n) be generated. In other cases, e.g. when the signal originates from a passenger sitting on the right front seat, it should not be generated. However, this information is represented by the weighting signal I(n), with which output signal $\hat{P}(n, k)$ is weighted in order to obtain the output signal of the Gain Calculation Block, i.e., detected speech signal P(n,k). Ideally, detected speech signal P(n,k) should only contain the power spectral density of the near-speaker's voice as perceived at the listener's ear positions, and this only when it is larger than the music or ambient noise signal present at the time at these very positions.

Figure 12:
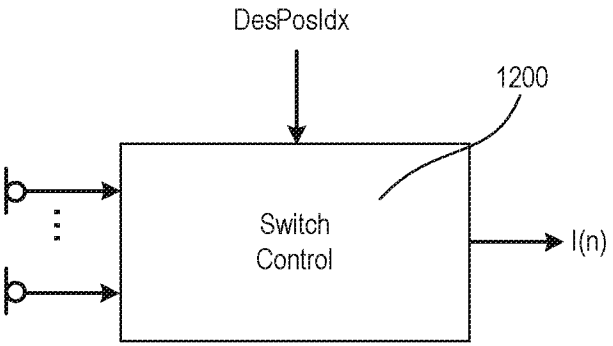
FIG. 12 is a schematic diagram illustrating the inputs and outputs of a switch control module applicable in the arrangement shown in FIG. 1.

FIG. 12 depicts a switch control module 1200 which may be used as switch control module 118 in the arrangement shown in FIG. 1. As illustrated in FIG. 12, determining whether a detected speech signal is coming from the assumed position of the near-speaker, or from a different position, is to be carried out using only the microphones installed in the room, as well as the presupposed position of the near-speaker stored by way of the variable DesPosIdx. The output signal, weighting signal I(n), which is to perform a time-variable, digital weighting of the detected speech signal P(n,k), should only then assume the value of 1 if the speech signal originates from the near-speaker, otherwise it should have the value of 0.

Figure 13:
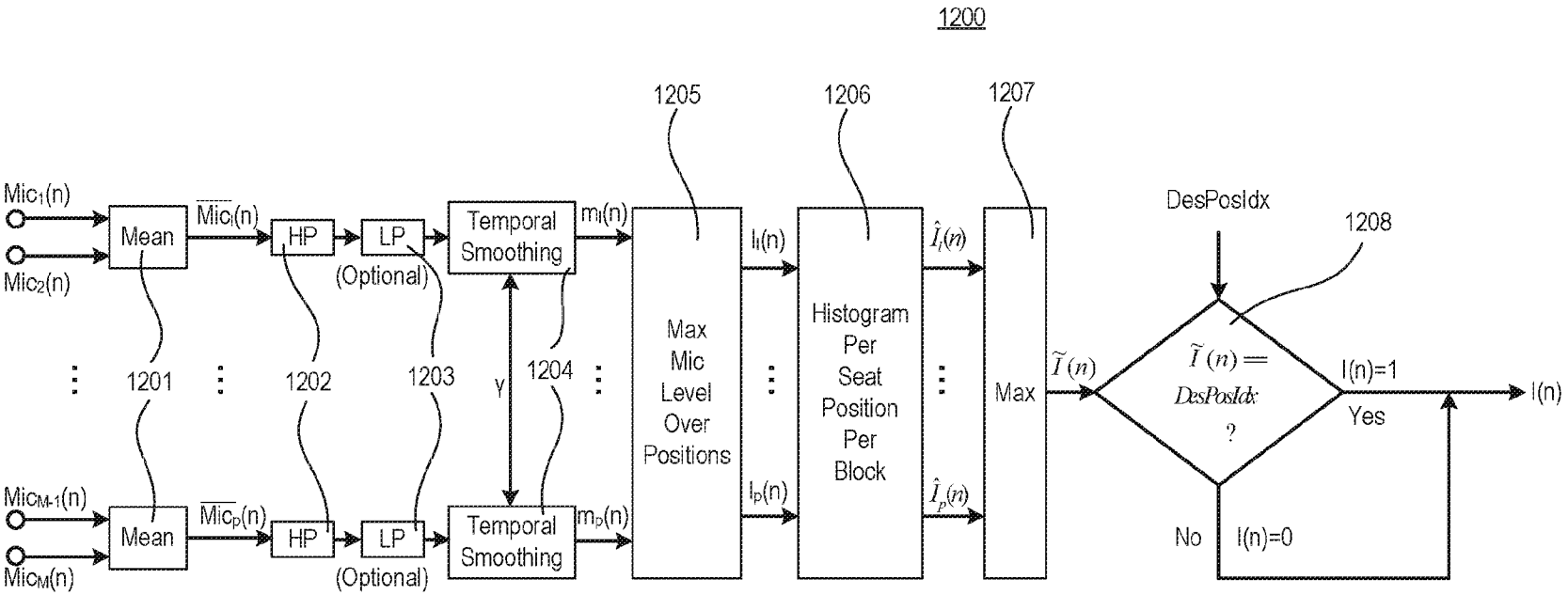
FIG. 13 is a block diagram depicting the structure of the switch control module shown in FIG. 12.

As shown in FIG. 13, in order to achieve this, the mean value of the positions indicated by the headrest microphones is calculated in mean calculation modules 1201, which roughly corresponds to the formation of a delay and sum beamformer and which generates mean microphone signals $\overline{Mic}_1, \ldots, \overline{Mic}_p$. All microphone signals $\overline{Mic}_1, \ldots, \overline{Mic}_p$ that refer to the seats P then undergo high-pass filtering by way of high-pass filters 1202. The high-pass filtering serves to ensure that ambient noise elements which, as mentioned earlier, in a motor vehicle lie predominantly in the lower spectral range, are suppressed and do not cause an incorrect detection. A second order Butterworth Filter with a base frequency of $f_c$=100 Hz, for example, may be used for this. As an option, low-pass filtering (by way of low-pass filters 1203) may also be used applying an accentuation, i.e., a limit, to the spectral range in which speech, as opposed to the typical ambient noise of motor vehicles, statistically predominates.

The thus spectrally limited microphone signals are then smoothed over time in temporal smoothing modules 1204 to provide P smoothed microphone signals $m_1(n), \ldots, m_P(n)$. Here a classic smoothing filter such as, for example, an infinite impulse response (IIR) low-pass filter of first order may be used in order to conserve energy. P index signals $I_1(n), \ldots, I_P(n)$ are then generated by a module 1205 from the P smoothed microphone signals $m_1(n), \ldots, m_P(n)$, which are digital signals and therefore can only assume a value of 1 or 0, whereas at the point in time n, only the signal possessing the highest level may take on the value of 1 representing the maximum microphone level over positions. As previously mentioned, the signal processing may be mainly carried out in the spectral range. This implicitly presupposes a processing in blocks, the length of which is determined by a feeding rate. Subsequently in a module 1206 a histogram is compiled out of the most recent L samples of index vectors $\underline{I}_p(n)$, with $$\underline{I}_p(n)=[I_p(n-L+1), \ldots, I_p(n)] \text{ and } p=[1, \ldots, P],$$

meaning that the number of times at which the maximum speech signal level appeared at the position P is counted. These counts are then passed on to a maximum detector module 1207 in the form of the signals $\hat{I}_1(n), \ldots, \hat{I}_p(n)$ at each time interval n. In the maximum detector module 1207 the signal with the highest count $\tilde{I}_1(n)$ at the time point n is identified and passed on to a comparison module 1208, where it is compared with the variable DesPosIdx, i.e., with the presupposed position of the near-speaker. If $\tilde{I}_1(n)$ and DesPosIdx correspond, this is confirmed with an output signal I(n)=1, if it is otherwise determined that the estimated speech signal $\hat{S}(n, k)$ does not originate at the position of the near-speaker, i.e., that $\tilde{I}_1(n) \neq$DesPosIdx, I(n) becomes 0.

Figure 14:
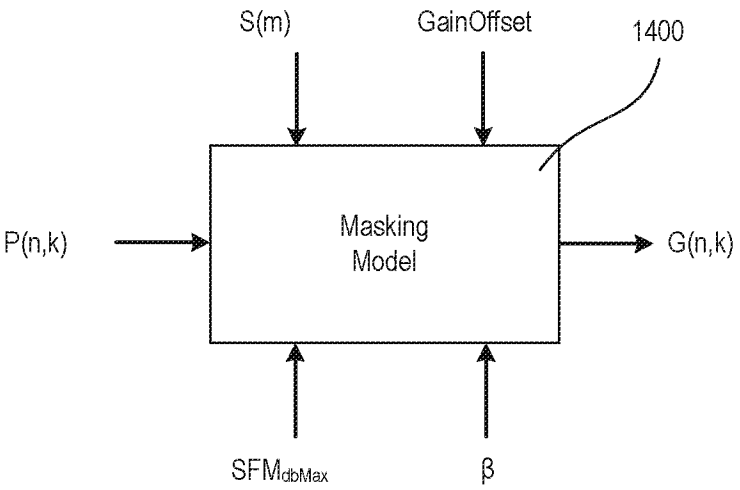
FIG. 14 is a schematic diagram illustrating the inputs and outputs of a masking model module applicable in the arrangement shown in FIG. 1.

FIG. 14 depicts a masking model module 1400 which may be used as masking model module 116 in the arrangement shown in FIG. 1. If the detected speech signal, which is in the present case power spectral density P(n,k) and which contains the signal of the near-speaker, is larger than the maximum value of the useful signal echo and the ambient noise, then it can be used directly to calculate the masking signal mn(n) or, to put it more precisely, the masking threshold or masking signal's magnitude frequency response G(n,k) or |MN(n,k)|, respectively. However, the masking effect of this signal may be generally too weak. This may be attributed to high and narrow, short-lived spectral peaks that occur within the detected speech signal P(n,k). A simple remedy for this might involve smoothing the spectrum of detected speech signal P(n,k) from high to low and from low to high using, for example, a first order IIR low-pass filter, which would enable the signal to be used to generate masking signal's magnitude frequency response G(n,k). This prevents, however, the masking effect of the high peaks within the detected speech signal P(n,k), which stimulate adjacent spectral ranges, from being correctly considered psycho-acoustically and from being reproduced in the masking signal mn(n) and thus significantly reduces the masking effect of the masking signal mn(n). This can be overcome by applying a masking model to calculate the masking threshold, masking signal's magnitude frequency response G(n,k), from the detected speech signal P(n,k), as, on the one hand, this will automatically clip the high peaks in the detected speech signal P(n,k), while, on the other hand, intrinsically considering the effect of the peaks on adjacent spectral ranges with the so-called spreading function. The result is an output signal that no longer exhibits a high, narrowband level, but possesses sufficient masking effect to produce a masking signal mn(n) that preserves its full suppressing potential.

As can be seen in FIG. 14, for this one needs, besides the detected speech signal P(n,k), additional input signals that exclusively control the masking model in order to generate as an output signal the masking threshold, e.g., the masking signal's magnitude frequency response G(n,k). Such additional input signals are a signal $SFM_{dB_{Max}}(n, m)$, a spreading function S(m), a parameter GainOffset, and a smoothing coefficient β. As previously mentioned, the masking threshold, the masking signal's magnitude frequency response G(n,k), generally corresponds to the frequency response of the masking noise and may thus be referred to as |MN(n, k)|. If, however, a masking model is used to generate the masking threshold, the masking signal's magnitude frequency response G(n,k), then the masking threshold will also correspond to the masking threshold of the input signal, which is the detected speech signal P(n,k). This explains the different designations used to denote the masking threshold.

Figure 15:
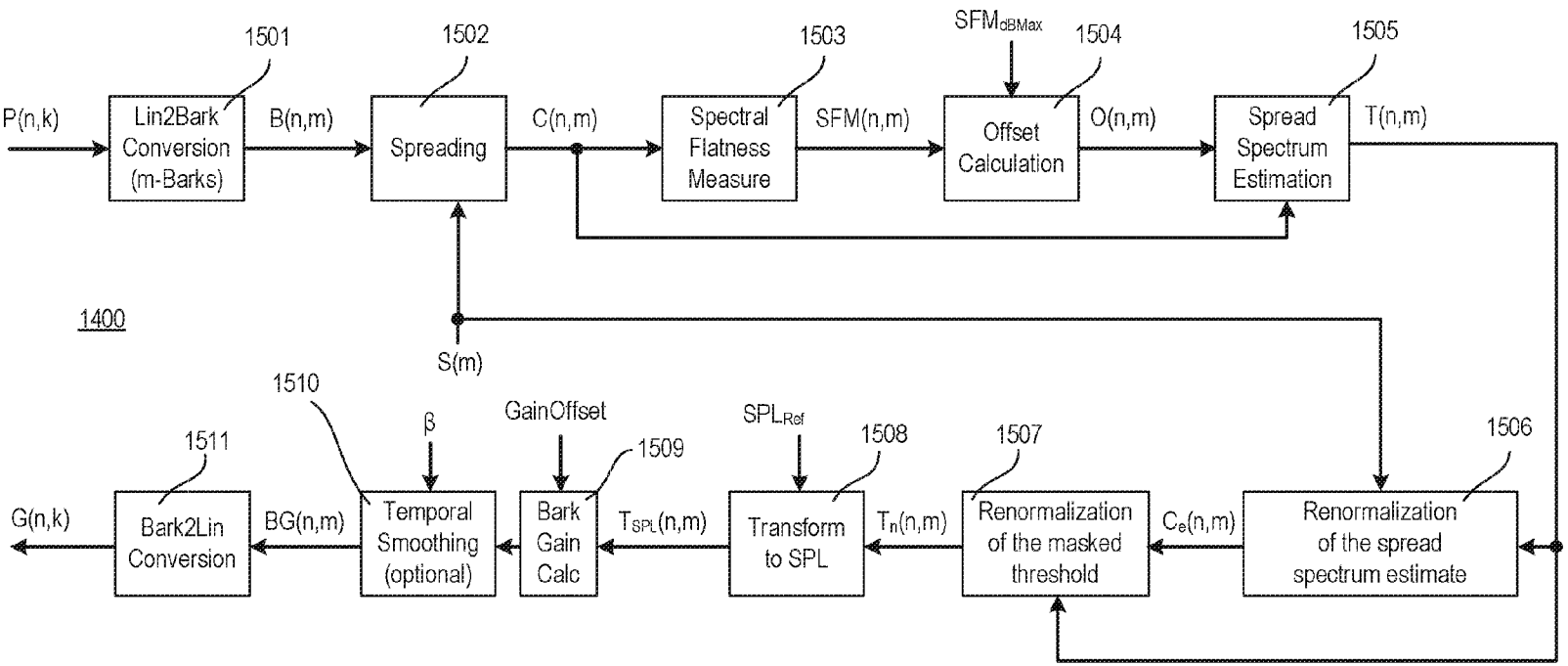
FIG. 15 is a block diagram depicting the structure of the masking model module shown in FIG. 14.

As can be seen in FIG. 15, which shows in detail the structure of the masking model module 1400, the input signal P(n,k) is transformed from the linear spectral range to the psychoacoustic Bark range in conversion module 1501. This significantly reduces the effort involved in processing the signal, as now only 24 Barks (critical bands) need to be calculated, as opposed to the M/2 Bins previously needed. The accordingly converted power spectral density B(n,m), whereas m=[1, . . . , B] and B=the maximum number of Barks (bands), is smoothed out by applying a spreading function S(m) thereto in a spreading module 1502 to provide a smoothed spectrum C(n,m). The smoothed spectrum C(n, m) is fed through a spectral flatness measure module 1503, where the smoothed spectrum C(n,m) is classified according to whether the input signal, at the point in time n, is more noise-like or more tonal, i.e., of a harmonic nature. The results of this classification are then recorded in a signal SFM(n,m) before being passed on to an offset calculation module 1504. Here, depending on whether the signal is noise-like or tonal, a corresponding offset signal O(n,m) is generated. The input signal $SFM_{dB_{Max}}(n, m)$ serves as a control parameter for the generation of O(n,m), which is then applied in a spread spectrum estimation module 1505 to modify the smoothed spectrum C(n,m), producing at the output an absolute masking threshold T(n,m).

In a module for renormalization of the spread spectrum estimate the absolute masking threshold T(n,m) is renormalized, which is necessary as an error is formed in the spreading block when the spreading function Sm) is applied, consisting in an unwarranted increase of the signals entire energy. Based on the spreading function S(m), the renormalization value Ce(n,m) is calculated in the module 1506 for renormalization of the spread spectrum estimate and is then used to correct the absolute masking threshold T(n,m) in an module 1507 for the renormalization of the masked threshold, finally producing the renormalized, absolute masking threshold $T_n$(n,m). In a transform to SPL module 1508, a reference sound pressure level (SPL) value $SPL_{Ref}$ is applied to the renormalized, absolute masking threshold $T_n$(n,m) to transform it into the acoustic sound pressure signal $T_{SPL}$(n,m) before being fed into a Bark gain calculation module 1509, where its value is modified only by the variable GainOffset, which can be set externally. The effect of the parameter GainOffset can be summed up as follows: the larger the variable GainOffset is, the larger the amplitude of the resulting masking signal nm(n) will be. The sum of signal $T_{SPL}$(n,m) and variable GainOffset may optionally be smoothed over time in a temporal smoothing module 1510, which may use a first order IIR low-pass filter with the smoothing coefficient β. The output signal from the temporal smoothing module 1510, which is a signal BG(n,m), is then converted from the Bark scale into the linear spectral range, finally resulting in the frequency response of the masking noise G(n,k). The masking model module 1400 may be based on the known Johnston Masking Model which calculates the masked threshold based on an audio signal in order to predict which components of the signal are inaudible.

Figure 16:
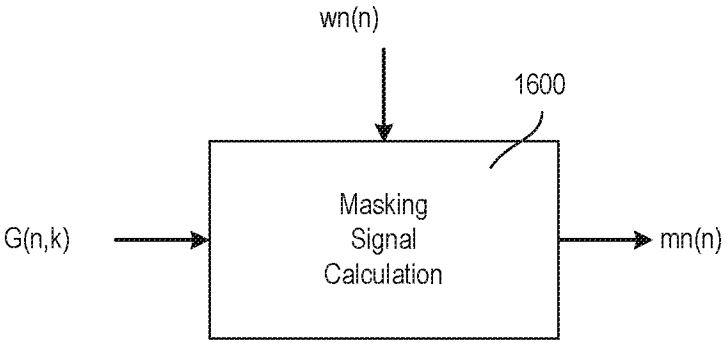
FIG. 16 is a schematic diagram illustrating the inputs and outputs of a masking signal calculation module applicable in the arrangement shown in FIG. 1.
Figure 17:
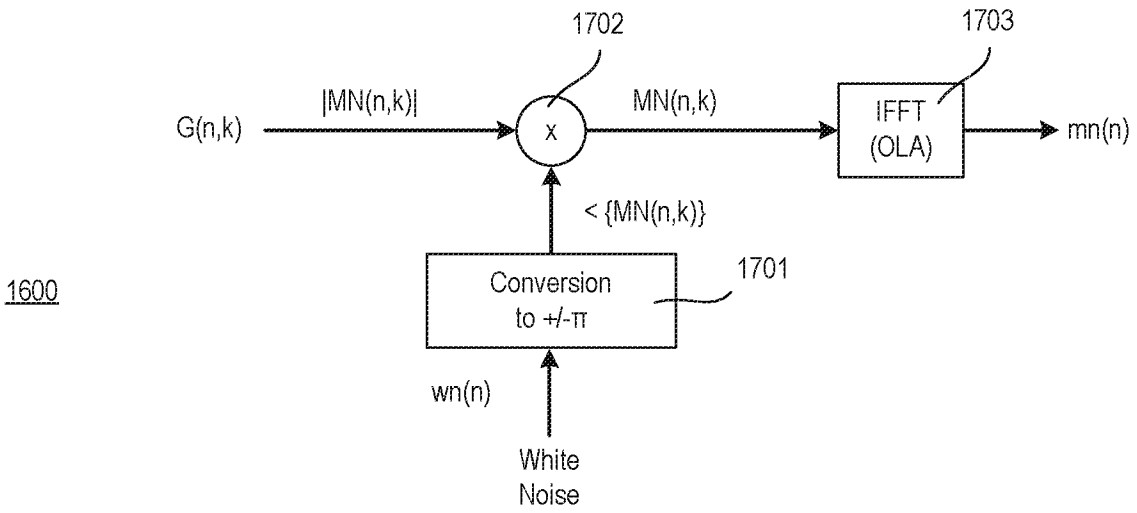
FIG. 17 is a block diagram depicting the structure of the masking signal calculation module shown in FIG. 16.

FIG. 16 depicts a masking signal calculation module 1600 which may be used as masking signal calculation module 117 in the arrangement shown in FIG. 1. Using the frequency response value of the masking noise G(n,k) and a white noise signal wn(n), the masking signal mn(n) in the time domain is calculated. A detailed representation of the structure of the masking signal calculation module 1600 is shown in FIG. 17. The frequency response of the masking signal is produced by simply converting the representation range, which, in the case of white noise, may be 0, . . . , 1, to $\measuredangle\{MN(n, k)\}=+\pi, \ldots, -\pi$ by way of a π-converter module 1701. Afterwards a complex signal $|MN(n, k)|e^{j\measuredangle\{MN(n,k)\}}$ is formed by a multiplier module 1702 and then converted into the time domain by a frequency domain to time domain converter module 1703 using the overlap add (OLA) method or an inverse fast Fourier transformation (IFFT), respectively, resulting in the desired masking signal mn(n) in the time domain.

Referring back to FIG. 1, the masking signal mn(n) can now be fed into an active system such as MIMO or ISZ system or a passive system with directional loudspeakers in connection with respective drivers, together with the useful signal(s) x(n) such as music, so that the signals can be heard only in predetermined zones within the room. This is of particular importance for the masking signal mn(n), as its masking effect is desired exclusively in a certain zone or position (e.g. the driver's seat or the front seat), whereas at other zones or positions (e.g. on the right or left back seat) the masking noise should ideally not be heard.

Figure 18:
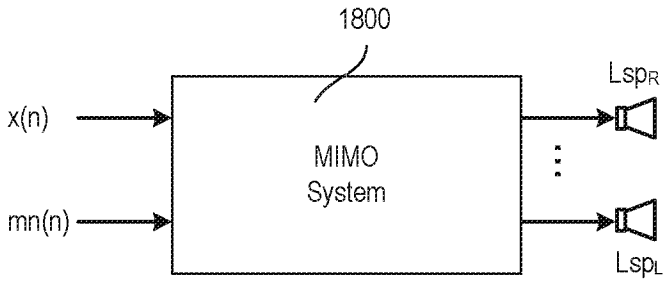
FIG. 18 is a schematic diagram illustrating the inputs and outputs of a multiple-input multiple-output (MIMO) system applicable in the arrangement shown in FIG. 1.

Referring now to FIG. 18, a MIMO system 1800, which may be used as MIMO system 110 in the arrangement shown in FIG. 1, may receive the useful signal x(n) and the masking signal mn(n) and output signals that may be supplied to the multiplicity of loudspeakers 102 the arrangement shown in FIG. 1. Any input signal can be fed into the MIMO system 1800 and each of these input signals can be assigned to its own sound zone. For example, the useful signal may be desired at all seating positions or only at the two front seating positions and the masking signal may only be intended for a single position, e.g., the front left seating position.

Figure 19:
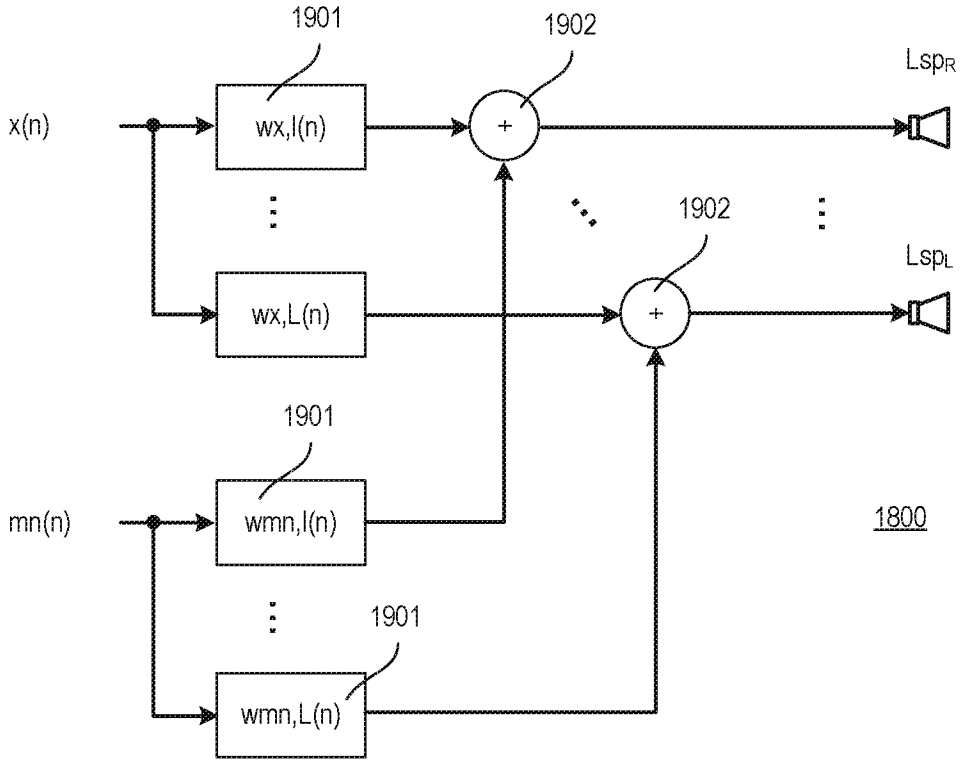
FIG. 19 is a block diagram depicting the structure of the MIMO system shown in FIG. 18.

As may be seen in FIG. 19, each input signal, e.g., the useful signal x(n) and the masking signal mn(n), that is intended for a different sound zone must be weighted using its own set of filters, e.g., a filter matrix 1901, the number of filters pro set or matrix corresponding to the number of output channels (number L of loudspeakers $Lsp_1, \ldots Lsp_L$ of the multiplicity of loudspeakers) and the number of input channels. The output signals for each channel can then be added up by way of adders 1902 before being passed on to the respective channels and their corresponding loudspeakers $Lsp_1, \ldots Lsp_L$.

Figure 20:
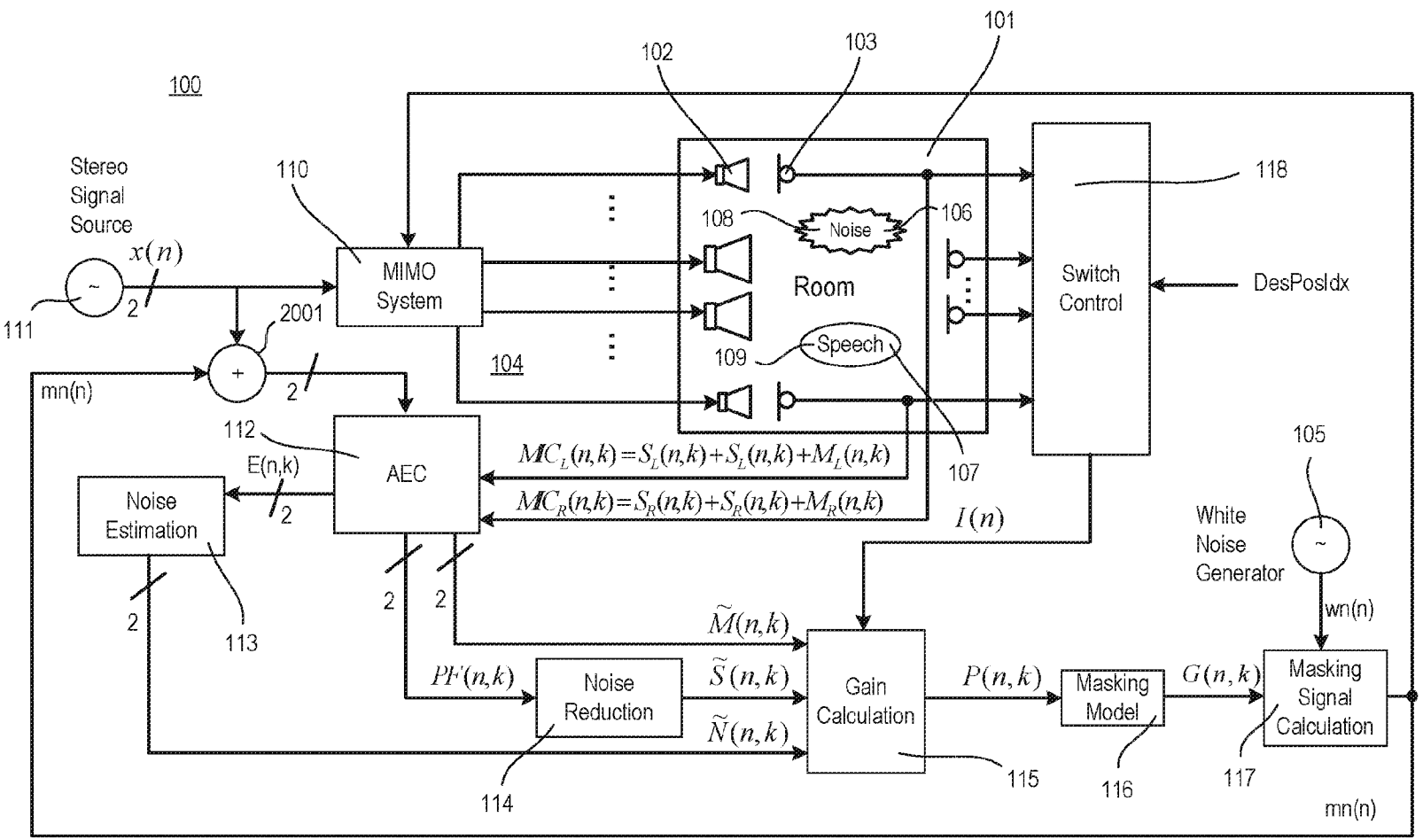
FIG. 20 is a block diagram illustrating another exemplary sound zone arrangement with speech suppression in at least one sound zone.

FIG. 20 illustrates another exemplary sound zone arrangement with speech suppression in at least one sound zone based on the arrangement shown in FIG. 1, however, in contrast to the arrangement shown in FIG. 1 where the masking signal mn(n) and the useful signal(s) x(n) are supplied directly to the AEC module 112, the masking signal mn(n) is fed back to AEC module 112 by adding (or overlaying) by way of an adder 2001 the masking signal mn(n) and the useful signal(s) x(n) before supplying this sum to the AEC module 112 so that the AEC module 112 if structured as, for example, the AEC module 300 shown in FIG. 4, can be simplified in that only four adaptive filters are required instead of six. As can be seen, the arrangement shown in FIG. 20 is more efficient but re-adaptation procedures may occur if the masking signal mn(n) and the useful signal(s) x(n) are not distributed via the same channels and loudspeakers.

Figure 21:
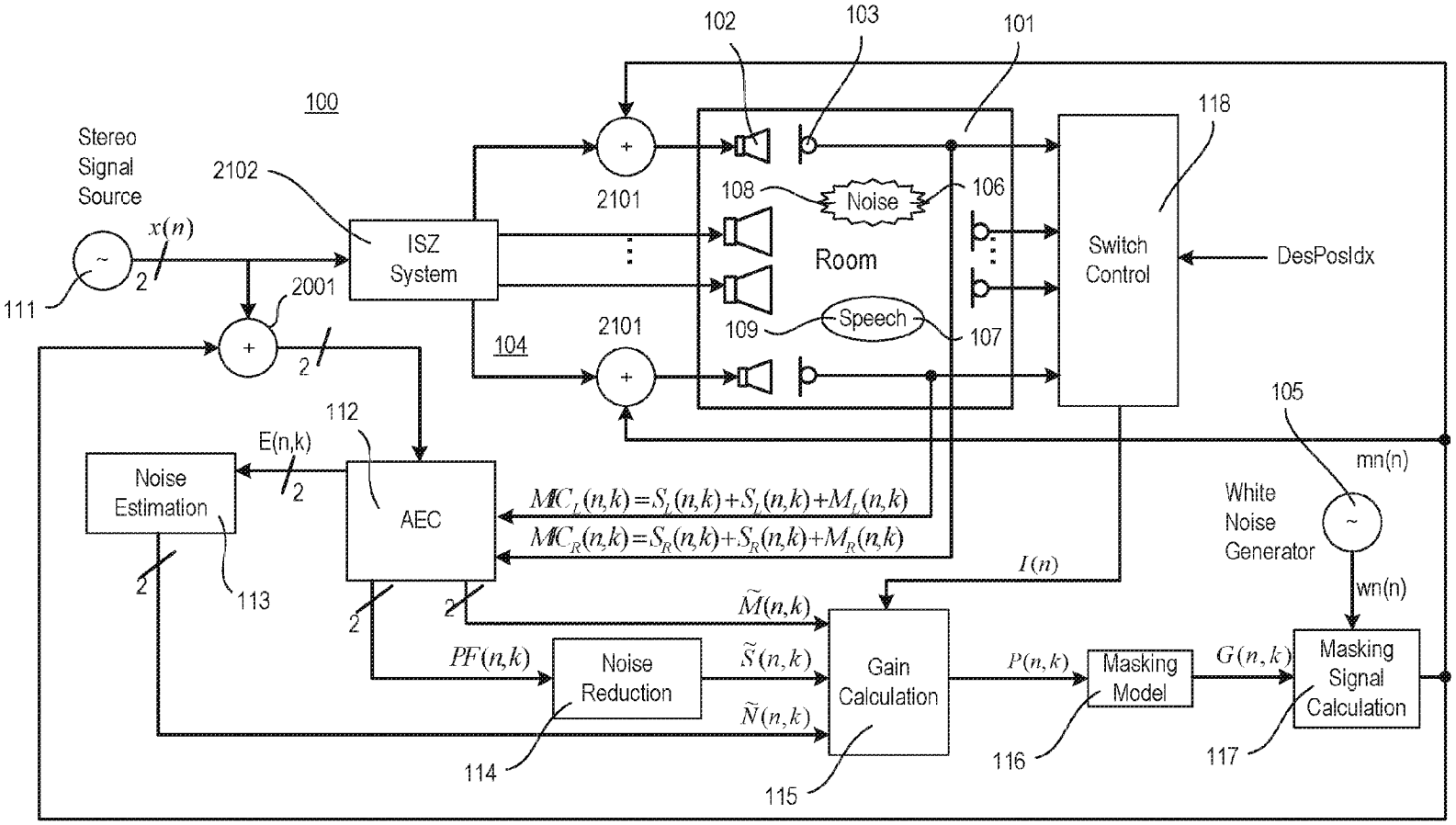
FIG. 21 is a block diagram illustrating still another exemplary sound zone arrangement with speech suppression in at least one sound zone.

Referring to FIG. 21, which is based on the arrangement shown in FIG. 20, the MIMO system 110 may be simplified by supplying the masking signal mn(n) to the loudspeakers without involving the MIMO system 110 of the arrangement shown in FIG. 1. For this, the masking signal mn(n) is added by way of two adders 2101 to the input signals of the two headrest loudspeakers 102*a* and 102*b* in the arrangement shown in FIG. 1 or the headrest loudspeakers 220 in the arrangement shown in FIG. 2. MIMO system 110, if structured as, for example, the MIMO system 1800 shown in FIG. 19, can be simplified in that the L adaptive filters in the filter matrix 1901 supplied with the masking signal mn(n) can be omitted to form an ISZ system 2102 if directional loudspeakers are used that exhibit a significant passive damping performance, e.g., nearfield loudspeakers such as loudspeakers in the headrests, loudspeaker with active beamforming circuits, loudspeaker with passive beamforming (acoustic lenses) or directional loudspeakers such as EDPLs in the headliner above the corresponding positions in the room, so that an ISZ system is formed as shown in FIG. 21.

Figure 22:
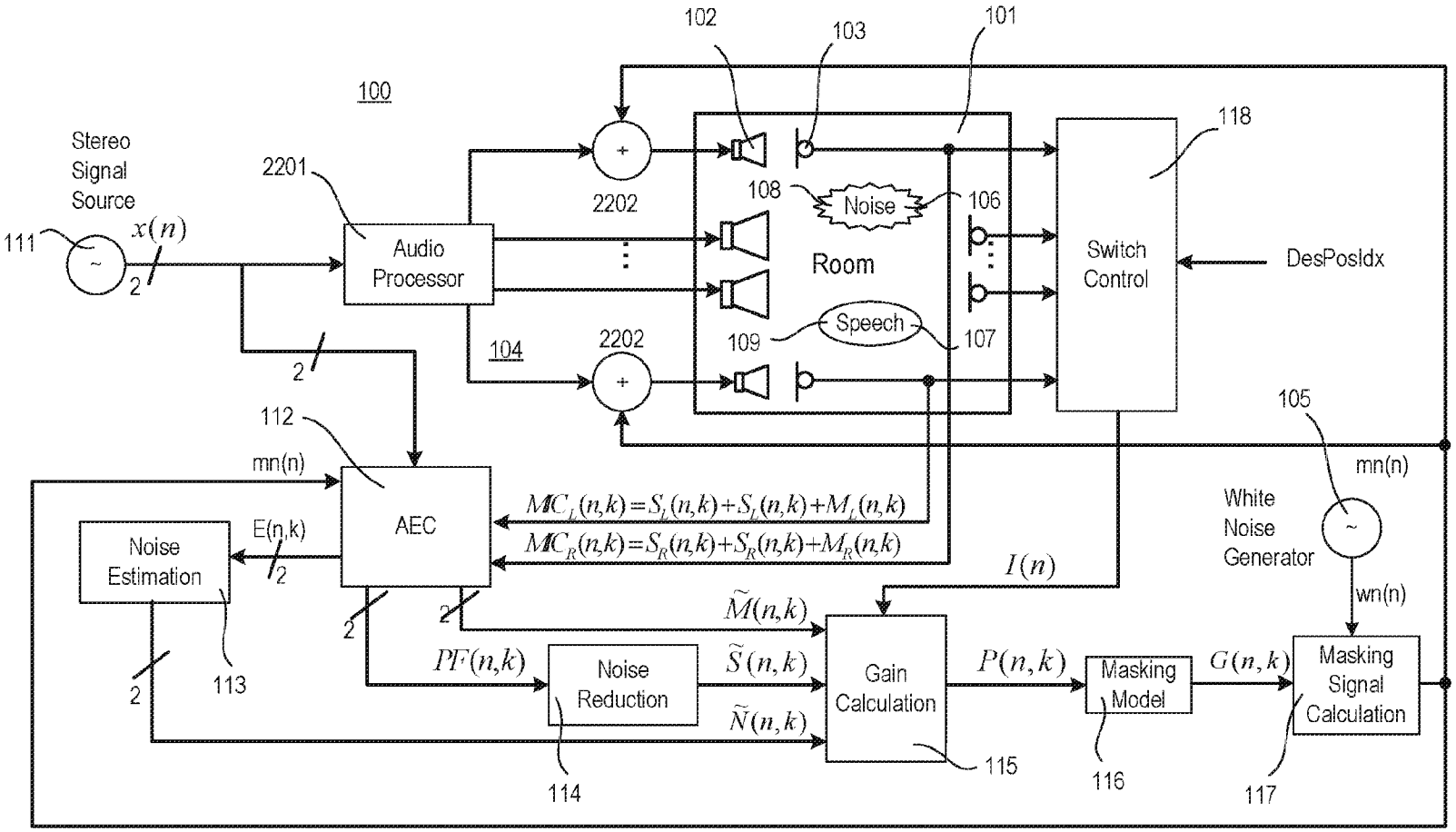
FIG. 22 is a block diagram illustrating still another exemplary sound zone arrangement with speech suppression in at least one sound zone.

Referring to FIG. 22, which is based on the arrangement shown in FIG. 1 a (e.g., non-adaptive) processing system 2201 may be employed instead of the MIMO system 110 of the arrangement shown in FIG. 1. The masking signal mn(n) is added by way of adders 2202 to the input signals of the loudspeakers 102 exhibiting a significant, passive damping performance, i.e., directional loudspeakers are used that exhibit a significant passive damping performance, e.g., nearfield loudspeakers such as loudspeakers in the headrests, loudspeaker with active beamforming circuits, loudspeaker with passive beamforming (acoustic lenses) or directional loudspeakers such as EDPLs in the headliner above the corresponding positions in the room, so that a passive system is formed as shown in FIG. 22. The masking signal mn(n) and the useful signal(s) x(n) are supplied separately to the AEC module 112.

It is understood that modules as used in the systems and methods described above may include hardware or software or a combination of hardware and software.

While various embodiments of the invention have been described, it will be apparent to those of ordinary skill in the art that many more embodiments and implementations are possible within the scope of the invention.

What is claimed is:

1. A sound zone arrangement comprising:

a multiplicity of loudspeakers disposed in a room that includes a listener's position and a speaker's position;

at least one microphone disposed in the room;

a signal processing module connected to the multiplicity of loudspeakers and the at least one microphone; the signal processing module configured to:

establish, in connection with the multiplicity of loudspeakers, a first sound zone around the listener's position and a second sound zone around the speaker's position;

determine, in connection with the at least one microphone, parameters of sound conditions present in the first sound zone; and generate in the first sound zone, in connection with the multiplicity of loudspeakers, and based on the determined sound conditions in the first sound zone, speech masking sound that is configured to reduce common speech intelligibility in the first sound zone.

2. The sound zone arrangement of claim 1, where the signal processing module comprises a masking signal calculation module configured to receive at least one signal representing the sound conditions in the first sound zone and to provide a speech masking signal based on a signal representing the sound conditions in the first sound zone and at least one of a psychoacoustic masking model and a common speech intelligibility model.

3. The sound zone arrangement of claim 2, where the signal processing module comprises a multiple-input multiple-output system configured to receive the speech masking signal and to generate, in connection with the multiplicity of loudspeakers and based on the speech masking signal, the speech masking sound in the first sound zone.

4. The sound zone arrangement of claim 2, where the multiplicity of loudspeakers comprises at least one of a directional loudspeaker, a loudspeaker with active beamformer, a nearfield loudspeaker and a loudspeaker with acoustic lens.

5. The sound zone arrangement of claim 2, where the signal processing module comprises:

an acoustic echo cancellation module connected to the at least one microphone to receive at least one microphone signal; the acoustic echo cancellation module configured to further receive at least the speech masking signal and configured to provide at least a signal representing an estimate of the acoustic echoes of at least the speech masking signal contained in the at least one microphone signal for determining the sound conditions in the first sound zone.

6. The sound zone arrangement of claim 5, where the signal processing module further comprises:

a noise reduction module configured to estimate speech signals contained in the microphone signals and to provide a signal representing the estimated speech signals; and a gain calculation module configured to receive the signal representing the estimated speech signals and to generate the signal representing the sound conditions in the first sound zone additionally based on the estimated speech signals.

7. The sound zone arrangement of claim 5, where the signal processing module further comprises a noise estimation module configured to estimate ambient noise signals contained in the microphone signals and to provide a signal representing the estimated noise signals; and a gain calculation module configured to receive the signal representing the estimated noise signals and to generate the signal representing the sound conditions in the first sound zone additionally based on the estimated noise signals.

8. The sound zone arrangement of claim 1, wherein:

the speaker in the second sound zone is a near speaker that communicates via a hands-free communications terminal to a remote speaker; and the signal processing module is further configured to direct sound from the communications terminal to the second sound zone and not to the first sound zone.

9. A method for arranging sound zones in a room including a listener's position and a speaker's position with a multiplicity of loudspeakers disposed in the room and at least one microphone disposed in the room; the method comprising:

establishing, in connection with the multiplicity of loudspeakers, a first sound zone around the listener's position and a second sound zone around the speaker's position;

determining, in connection with the at least one microphone, parameters of sound conditions present in the first sound zone; and generating in the first sound zone, in connection with the multiplicity of loudspeakers, and based on the determined sound conditions in the first sound zone, speech masking sound that is configured to reduce common speech intelligibility in the first sound zone.

10. The method of claim 9, further comprising:

providing a speech masking signal based on a signal representing the sound conditions in the first sound zone and at least one of a psychoacoustic masking model and a common speech intelligibility model.

11. The method of claim 10, further comprising, for establishing the sound zones, at least one of:

processing the speech masking signal in a multiple-input multiple-output system to generate, in connection with the multiplicity of loudspeakers and based on the speech masking signal, the speech masking sound in the first sound zone; and employing at least one of a directional loudspeaker, a loudspeaker with active beamformer, a nearfield loudspeaker and a loudspeaker with acoustic lens.

12. The method of claim 10, further comprising:

generating, based on at least the speech masking signal, at least one signal representing an estimate of acoustic echoes of at least the speech masking signal contained in microphone signals; and generating the signal representing the sound conditions in the first sound zone based on the estimate of the echoes of at least the speech masking signal contained in the microphone signals.

13. The method of claim 12, further comprising:

estimating speech signals contained in the microphone signals and providing a signal representing the estimated speech signals; and generating the signal representing the sound conditions in the first sound zone based additionally on the estimated speech signals.

14. The method of claim 13, further comprising:

estimating ambient noise signals contained in the microphone signals and providing a signal representing the estimated noise signals; and generating the signal representing the sound conditions in the first sound zone based additionally on the estimated noise signals.

15. The method of claim 9, wherein:

the speaker in the second sound zone is a near speaker that communicates via a hands-free communications terminal to a remote speaker; the method further comprising:

directing sound from the communications terminal to the second sound zone and not to the first sound zone.

16. A sound zone arrangement comprising:

a signal processing module connected to a multiplicity of loudspeakers disposed in a room that includes a listener's position and a speaker's position and at least one microphone disposed in the room; the signal processing module configured to:

establish, in connection with the multiplicity of loudspeakers, a first sound zone around the listener's position and a second sound zone around the speaker's position;

determine, in connection with the at least one microphone, parameters of sound conditions present in the first sound zone; and generate in the first sound zone, in connection with the multiplicity of loudspeakers, and based on the determined sound conditions in the first sound zone, speech masking sound that is configured to reduce common speech intelligibility in the first sound zone.

17. The sound zone arrangement of claim 16, where the signal processing module comprises a masking signal calculation module configured to receive at least one signal representing the sound conditions in the first sound zone and to provide a speech masking signal based on the signal representing the sound conditions in the first sound zone and at least one of a psychoacoustic masking model and a common speech intelligibility model.

18. The sound zone arrangement of claim 17, where the signal processing module comprises a multiple-input multiple-output system configured to receive the speech masking signal and to generate, in connection with the multiplicity of loudspeakers and based on the speech masking signal, the speech masking sound in the first sound zone.

19. The sound zone arrangement of claim 17, wherein the signal processing module comprises:

an acoustic echo cancellation module connected to the at least one microphone to receive at least one microphone signal; the acoustic echo cancellation module configured to further receive at least the speech masking signal and configured to provide at least a signal representing an estimate of the acoustic echoes of at least the speech masking signal contained in the at least one microphone signal for determining the sound conditions in the first sound zone.

20. The sound zone arrangement of claim 19, where the signal processing module further comprises:

a noise reduction module configured to estimate speech signals contained in the microphone signals and to provide a signal representing the estimated speech signals; and a gain calculation module configured to receive the signal representing the estimated speech signals and to generate the signal representing the sound conditions in the first sound zone additionally based on the estimated speech signals.

* * * * *